US010547952B1

(12) United States Patent
Liang

(10) Patent No.: US 10,547,952 B1
(45) Date of Patent: Jan. 28, 2020

(54) SOUND PRODUCING APPARATUS

(71) Applicant: xMEMS Labs, Inc., Los Altos, CA (US)

(72) Inventor: Jemm Yue Liang, Sunnyvale, CA (US)

(73) Assignee: xMEMS Labs, Inc., Los Altos, CA (US)

( * ) Notice: Subject to any disclaimer, the term of this patent is extended or adjusted under 35 U.S.C. 154(b) by 0 days.

(21) Appl. No.: 16/420,190

(22) Filed: May 23, 2019

Related U.S. Application Data

(60) Provisional application No. 62/748,103, filed on Oct. 19, 2018, provisional application No. 62/813,095, filed on Mar. 3, 2019.

(51) Int. Cl.

| | |
|---|---|
| ***H04R 19/02*** | (2006.01) |
| ***H04R 7/04*** | (2006.01) |
| ***H04R 3/04*** | (2006.01) |
| ***G10K 9/13*** | (2006.01) |

(52) U.S. Cl.
CPC ..... *H04R 19/02* (2013.01); *G10K 9/13* (2013.01); *H04R 3/04* (2013.01); *H04R 7/04* (2013.01)

(58) Field of Classification Search
CPC . G10K 9/13; H04R 19/02; H04R 3/04; H04R 7/04; H04R 1/28; H04R 1/24; H04R 2201/003; H04R 9/063
USPC ..... 181/156
See application file for complete search history.

(56) References Cited

U.S. PATENT DOCUMENTS

| | | | | |
|---|---|---|---|---|
| 8,009,846 | B2 * | 8/2011 | Sekino | B06B 1/0292 181/156 |
| 8,861,752 | B2 | 10/2014 | Margalit | |
| 9,571,938 | B2 | 2/2017 | Schelling | |
| 10,284,961 | B2 | 5/2019 | Margalit | |
| 10,327,060 | B2 * | 6/2019 | Lo | H04R 1/02 |
| 2013/0129117 | A1 * | 5/2013 | Thomsen | H04R 3/00 381/111 |
| 2013/0223023 | A1 * | 8/2013 | Dehe | B81B 7/0029 361/752 |
| 2016/0088418 | A1 | 3/2016 | Sato | |
| 2016/0134872 | A1 * | 5/2016 | Su | H04N 19/176 375/240.03 |

(Continued)

OTHER PUBLICATIONS

Jemm Yue Liang, Title of Invention: Sound Producing Apparatus, U.S. Appl. No. 16/420,141, filed May 22, 2019.

(Continued)

*Primary Examiner* — Forrest M Phillips
(74) *Attorney, Agent, or Firm* — Winston Hsu

(57) ABSTRACT

A sound producing apparatus is provided. The sound producing apparatus comprises a driving circuit, comprising a pulse amplitude modulation (PAM) module, configured to generate an driving signal according to an audio input signal, wherein the driving signal comprises a pulse amplitude modulated signal generated according to the audio input signal, the pulse amplitude modulated signal comprises a plurality of pulses at a pulse rate, two consecutive pulses among the plurality of pulses are temporally spaced by a pulse cycle, the pulse rate is a reciprocal of the pulse cycle, and the pulse rate is larger than a maximum audible frequency; and a sound producing device, coupled to the driving circuit, configured to produce sound according to the driving signal.

19 Claims, 21 Drawing Sheets

(56) References Cited

U.S. PATENT DOCUMENTS

2016/0381464 A1* 12/2016 Elyada ..... H04R 19/02
381/97
2017/0201192 A1* 7/2017 Tumpold ..... H01L 41/081

OTHER PUBLICATIONS

Jemm Yue Liang, Title of Invention: Sound Producing Apparatus, U.S. Appl. No. 16/420,184, filed May 23, 2019.

* cited by examiner

SOUND PRODUCING APPARATUS

CROSS REFERENCE TO RELATED APPLICATIONS

This application claims the benefit of U.S. provisional application No. 62/748,103, filed on Oct. 19, 2018, and U.S. provisional application No. 62/813,095, filed on Mar. 3, 2019, which are all incorporated herein by reference.

BACKGROUND OF THE INVENTION

1. Field of the Invention

The present invention relates to a sound producing apparatus, and more particularly, to a sound producing apparatus capable of producing sound at a pulse rate, where the pulse rate is higher than the maximum audible frequency.

2. Description of the Prior Art

Speaker driver is always the most difficult challenge for high-fidelity sound reproduction in the speaker industry. The physics of sound wave propagation teaches that, within the human audible frequency range, the sound pressures generated by accelerating a membrane of a conventional speaker drive may be expressed as $P \propto SF \cdot AR$, where SF is the membrane surface area and AR is the acceleration of the membrane. Namely, the sound pressure P is proportional to the product of the membrane surface area SF and the acceleration of the membrane AR. In addition, the membrane displacement DP may be expressed as $DP \propto \frac{1}{2} \cdot AR \cdot T^2 \propto 1/f^2$, where T and f are the period and the frequency of the sound wave respectively. The air volume movement $V_{A,CV}$ caused by the conventional speaker driver may then be expressed as $V_{A,CV} \propto SF \cdot DP$. For a specific speaker driver, where the membrane surface area is constant, the air movement $V_{A,CV}$ is proportional to $1/f^2$, i.e., $V_{A,CV} \propto 1/f^2$.

To cover a full range of human audible frequency, e.g., from 20 Hz to 20 KHz, tweeter(s), mid-range driver(s) and woofer(s) have to be incorporated within a conventional speaker. All these additional components would occupy large space of the conventional speaker and will also raise its production cost. Hence, one of the design challenges for the conventional speaker is the impossibility to use a single driver to cover the full range of human audible frequency.

Another design challenge for producing high-fidelity sound by the conventional speaker is its enclosure. The speaker enclosure is often used to contain the back-radiating wave of the produced sound to avoid cancelation of the front radiating wave in certain frequencies where the corresponding wavelengths of the sound are significantly larger than the speaker dimensions. The speaker enclosure can also be used to help improve, or reshape, the low-frequency response, for example, in a bass-reflex (ported box) type enclosure where the resulting port resonance is used to invert the phase of back-radiating wave and achieves an in-phase adding effect with the front-radiating wave around the port-chamber resonance frequency. On the other hand, in an acoustic suspension (closed box) type enclosure where the enclosure functions as a spring which forms a resonance circuit with the vibrating membrane. With properly selected speaker driver and enclosure parameters, the combined enclosure-driver resonance peaking can be leveraged to boost the output of sound around the resonance frequency and therefore improves the performance of resulting speaker.

Therefore, how to design a small sound producing device while overcoming the design challenges faced by conventional speakers as stated above is an important objective in the field.

SUMMARY OF THE INVENTION

It is therefore a primary objective of the present invention to provide a sound producing device capable of producing sound at a pulse rate, where the pulse rate is higher than the maximum audible frequency.

An embodiment of the present invention provides a sound producing apparatus. The sound producing apparatus comprises a driving circuit, comprising a pulse amplitude modulation (PAM) module, configured to generate an driving signal according to an audio input signal, wherein the driving signal comprises a pulse amplitude modulated signal generated according to the audio input signal, the pulse amplitude modulated signal comprises a plurality of pulses at a pulse rate, two consecutive pulses among the plurality of pulses are temporally spaced by a pulse cycle, the pulse rate is a reciprocal of the pulse cycle, and the pulse rate is larger than a maximum audible frequency; and a sound producing device, coupled to the driving circuit, configured to produce sound according to the driving signal.

An embodiment of the present invention provides a sound producing apparatus. The sound producing apparatus comprises a sound producing device, comprising a plurality of cells, wherein the plurality of cells comprise a plurality of membranes and a plurality of membrane electrodes; a driving circuit, comprising a sampling module, receiving an audio input signal, configured to obtain a plurality of samples of the audio input signal at a plurality of sampling time instant; a summing module, configured to perform a summing operation on the plurality of samples, to obtain a driving voltage; and a converting module, configured to generate a plurality of cell driving voltages according to the driving voltage; wherein the plurality of cell driving voltages is applied to the plurality of membrane electrodes.

These and other objectives of the present invention will no doubt become obvious to those of ordinary skill in the art after reading the following detailed description of the preferred embodiment that is illustrated in the various figures and drawings.

DETAILED DESCRIPTION

To overcome the design challenges of speaker driver and enclosure within the sound producing industry, Applicant provides the sound producing MEMS (micro-electrical-mechanical-system) device in U.S. application Ser. No. 16/125,761, so as to produce sound in an air pulse rate/frequency, where the air pulse rate is higher than the maximum (human) audible frequency.

Figure 1:
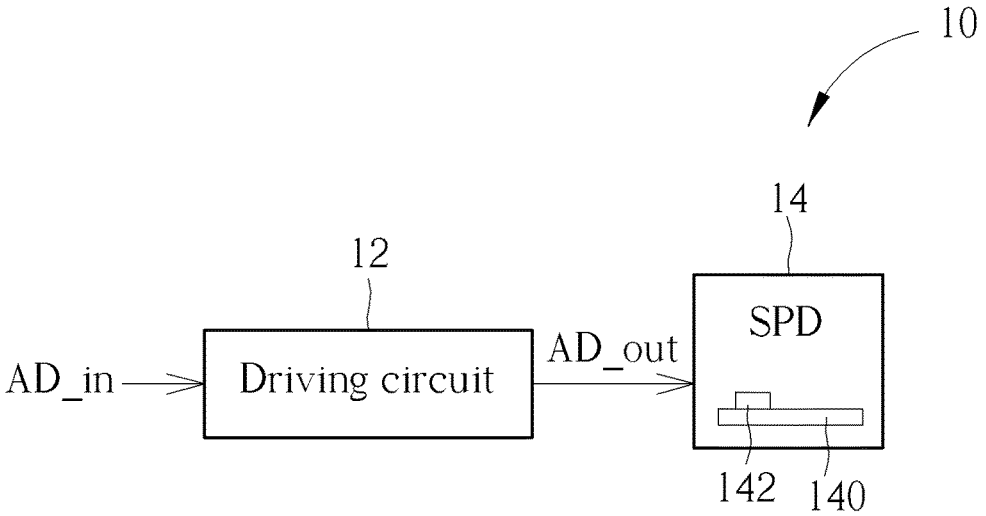
FIG. 1 is a schematic diagram of a sound producing apparatus according to an embodiment of the present invention.

The sound producing device in U.S. application Ser. No. 16/125,761 requires valves and membrane to producing the air pulses. To achieve such fast pulse rate, the valves need to be able to perform open-and-close operation within roughly 2.6-3.9 μS. The fast moving valves would need to endure dust, sweat, hand grease, ear wax, and be expected to survive over trillion cycles of operation, which are beyond challenging. The present application provides a sound producing apparatus, producing audible sound utilizing an array of air pulses at the pulse rate higher than the maximum audible frequency, without using valves. Specifically, the present application takes advantage of the following characteristics of PAM sound producing devices as discussed in U.S. application Ser. No. 16/125,761. First, the amplitudes of pulses within pluralities of air pulses determine, independently from the frequency of the envelope of the pluralities of air pulses, the SPL (sound pressure level) of the audible sound produced by PAM sound producing devices. Further, under a given SPL, the relationship between net membrane displacement DP and frequency of the audible sound f becomes of the conventional speaker drivers FIG. 1 is a schematic diagram of a sound producing apparatus 10 according to an embodiment of the present invention. The sound producing apparatus 10 comprises a driving circuit 12 and a sound producing device (SPD) 14. The driving circuit 12 receives an audio input signal AD_in and generates a driving signal AD_out according to the audio input signal AD_in. The SPD 14 comprising a sound producing membrane 140 and an electrode 142 attached to the membrane 140. The electrode 142 is coupled to the driving circuit 12 to receive the driving signal AD_out, such that the SPD 14 is able to produce a plurality of air pulses at an air pulse rate, where the air pulse rate is higher than a maximum human audible frequency, like what U.S. application Ser. No. 16/125,761 does.

For the air pulse rate being significantly above human audible frequency, sometimes reaching an ultrasonic frequency, the plurality of air pulses produced by the sound producing apparatus 10 may be named as an ultrasonic pulse array (UPA).

Similar to U.S. application Ser. No. 16/125,761, each one of the plurality of air pulses generated by the SPD 14 would have non-zero offset in terms of SPL, where the non-zero offset is a deviation from a zero SPL. Also, the plurality of air pulses generated by the SPD 14 is aperiodic over a plurality of pulse cycles. Details of the "non-zero SPL offset" and the "aperiodicity" properties may be refer to the U.S. application Ser. No. 16/125,761, which are not narrated herein for brevity.

In an embodiment, the membrane electrode 142 would produce a driving force applied to drive the membrane and proportional to the driving signal AD_out. In this case, the SPD 14 may be a conventional speaker based on electromagnetic force, or electrostatic force, e.g., a treble speaker or a tweeter.

Specifically, the SPD 14 is a "force-based" sound producing device, where the driving force proportional to driving signal is produced via the interaction of driving current (or voltage) and a permanent magnetic (or electric) field, and this force subsequently causes the membrane to act on the air and produce the desired sound pressure. For the force-based SPD, the driving signal and the SPL of air pressure pulse generated is directly correlated. The force-based sound producing device can be summary by F=gS, where F denotes the force produced by the SPD, S denotes an input signal (which may be AD_in in this case), g denotes a constant.

In order to produce the plurality of air pulses, different from all the driving circuit within the sound producing apparatus in the prior art, the driving circuit 12 comprises a pulse amplitude modulation (PAM) module. The PAM module is configured to generate a pulse amplitude modulated signal at a pulse rate, where the pulse rate is significantly higher than the maximum audible frequency. The driving signal AD_out, driving the sound producing device 14, comprises the pulse amplitude modulated signal, which is in form of a plurality of pulses (described later on) with a pulse rate.

Figure 2:
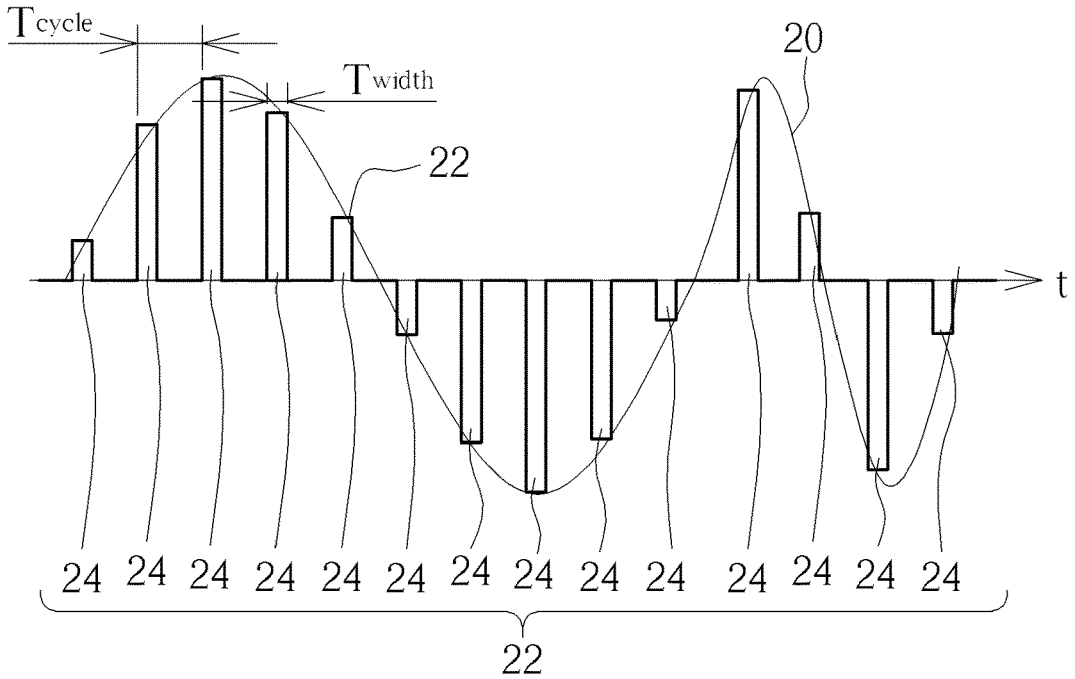
FIG. 2 is a schematic diagram of a plurality of signals according to an embodiment of the present invention.

FIG. 2 is a schematic diagram of an input signal 20, a pulse amplitude modulated signal 22 and a plurality of pulses 24 according to an embodiment of the present invention. The input signal 20, fed into the PAM module, may be the audio input signal AD_in or related to the audio input signal AD_in. The pulse amplitude modulated signal 22, generated by the PAM module, comprises the plurality of pulses 24. The plurality of pulses 24 are produced at a pulse rate $R_P$. Specifically, every two consecutive pulses 24 are temporally spaced by a pulse cycle $T_{cycle}$, and the pulse rate $R_P$ is a reciprocal of the pulse cycle $T_{cycle}$, i.e., $R_P=1/T_{cycle}$. The pulse rate $R_P$ is larger than a maximum audible frequency (e.g., 20 KHz). For example, the pulse rate $R_P$ may be 30 KHz or 96 KHz. The driving signal AD_out may comprise the pulse amplitude modulated signal such as the signal 22.

Note that, different from amplitude modulation (AM) which modulates the input signal using sinusoidal wave at a carrier frequency and each cycle of the sinusoidal wave has a zero mean value, each individual pulse 24 of a PAM scheme as shown in FIG. 2 (analogous to the sinusoidal wave in the AM methodology) has non-zero average within the pulse cycle $T_{cycle}$. Even the audio input signal AD_in is modulated toward a high frequency such as the pulse rate $R_P$ (higher than the maximum audible frequency, analogous to the carrier frequency in the AM methodology), the pulse amplitude modulated signal 22 and/or the driving signal AD_out would have nonzero low frequency component (i.e., the in-band signal component, which is audible) of the pulse amplitude modulated signal 22 and/or the driving signal AD_out.

Due to the fact that the ambient objects and human ear passages perform a certain degree of low pass filtering effect, the high frequency component (i.e., the out-of-band signal component which is beyond highest frequency audible to human hearing) would be absorbed/attenuated, and only the in-band signal component can be perceived. The ambient objects may be wall, window, window dressing, carpet, floor, ceiling, etc., and the human ear passages may be from the outer ear, through the ear canal and the eardrum, to the malleus, incus and stapes.

In another perspective, the sound producing device 14, being a treble speaker (e.g., Aurum Cantus AST 2560), may have wide range of flat frequency response (94.5±2 dB from 1.05 KHz-40 KHz) while keeping the harmonic distortion less than 1%. By applying the driving circuit 12 which generates the PAM signal at the pulse rate $R_P$, the sound producing device 14 may successfully produce sound with high sound pressure level (SPL) at the pulse rate $R_P$ and with low harmonic distortion, and the produced sound perceived by human ear can be down to 20~30 Hz, which would normally require the use of a subwoofer.

In addition, the membrane movement of the SPD 14 driven by the PAM-UPA scheme is proportional to (1/f), where f is the frequency of audible sound, is much smaller than the membrane movement of speaker driven by conventional speaker driving scheme, where the membrane movement is proportional to ($1/f^2$). Therefore, the size/volume required by the SPD 14 is significantly smaller than the conventional speaker for producing sound at low audio frequency like f=20 Hz.

Furthermore, the low audio frequency which the conventional speaker can achieve is limited by the linear excursion range thereof. For example, $f_{low}$ may represent a lowest audio frequency which a tweeter can achieve within the linear excursion range. Using the PAM-UPA driving scheme, since the relationship between linear excursion and the sound frequency will change from $1/f^2$ of conventional scheme to 1/f of PAM-UPA driving scheme, the lowest audio frequency achievable by the same tweeter may be extended downward by a factor of $f_{Pulse}/f_{low}$, where $f_{Pulse}$ is the PAM-UPA pulse rate. Take Aurum Cantus AST2560 as an example, where $f_{Low}$=1.05 KHz and assume $f_{Pulse}$=38 KHz, then the extended $f_{Low}$=1050/(38/1.05)=29 Hz which is a frequency that may require the use of a subwoofer in the conventional driving method.

In other words, by utilizing the driving circuit 12, generating the PAM signal at the pulse rate $R_P$, to drive the treble speaker (tweeter) 14, the sound producing apparatus 10 is able to produce sound in much wider audible frequency range without using the bass speaker (woofer), where a size/volume of the bass speaker (woofer) is tremendously larger than which of the treble speaker (tweeter) 14. That is, the size/volume of the sound producing apparatus 10, capable of producing sound below 30 Hz with high SPL, can be greatly reduced.

In the present application, the pulse rate $f_{Pulse}$ in terms of Hertz and the pulse rate $R_P$, which may be in terms of pulses per second (abbreviated as pps) or Hertz, are used interchangeably.

Figure 3:
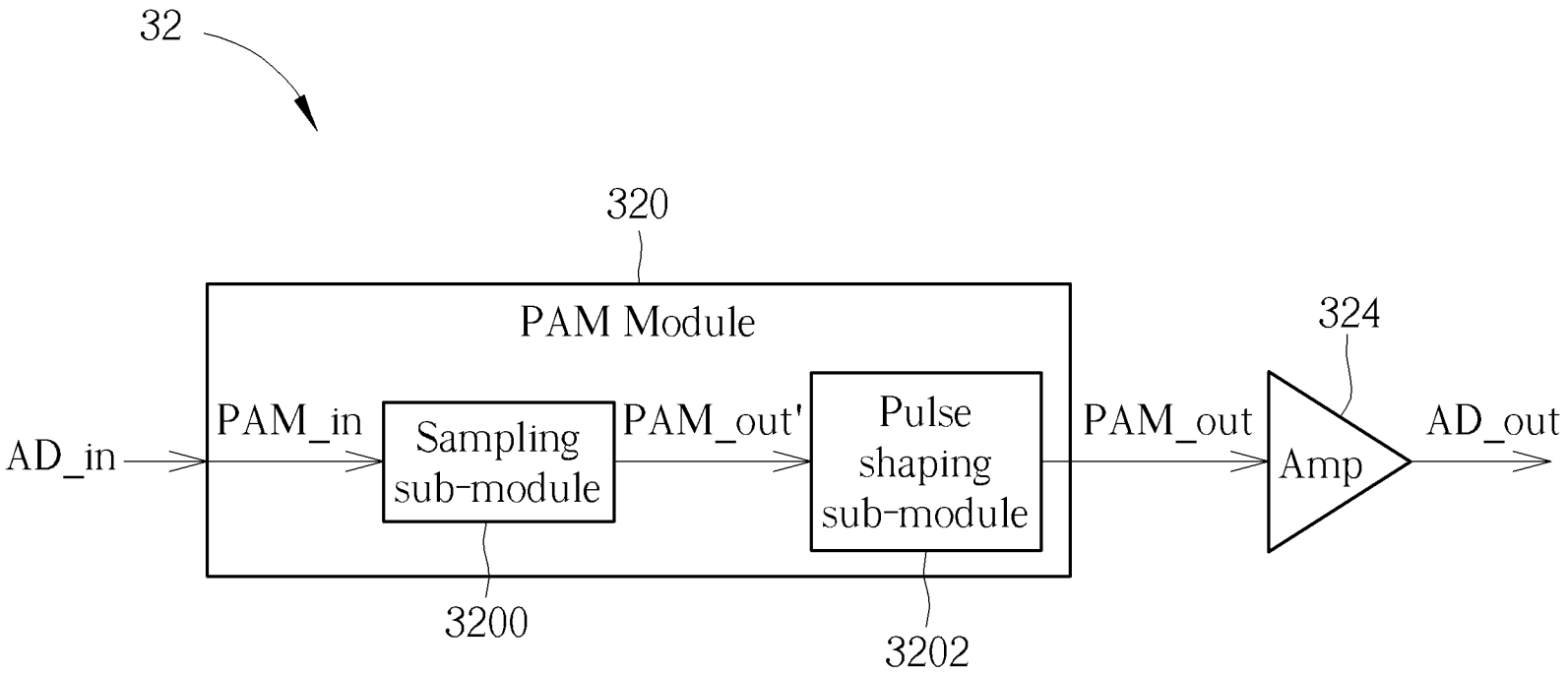
FIG. 3 is a schematic diagram of a driving circuit according to an embodiment of the present invention.

FIG. 3 is a schematic diagram of the driving circuit 32 according to an embodiment of the present invention. The driving circuit 32 comprises a PAM module 320 and the PAM module 320 may comprise a sampling sub-module 3200 and a pulse shaping sub-module 3202. In addition to the PAM module 320, the driving circuit 320 also comprises a power amplifier 324, coupled to the PAM module 320 and configured to output the driving signal AD_out to drive the sound producing device 14. Note that, the signals stated in the above are not limited to be digital or analog. Conversion circuit(s) such as digital-to-analog converter (DAC) and/or analog-to-digital converter (ADC) may be inserted as necessary. For example, if the format of signal PAM_out is digital, a DAC may be inserted/coupled between the PAM module 320 and the power amplifier 324, which is omitted in FIG. 3 for brevity.

The sampling sub-module 3200 is configured to obtain a plurality of samples of an input signal PAM_in corresponding to a plurality of sampling time instant $T_S$. Mathematically, the sampling sub-module 3200 obtains PAM_in[n]=PAM_in(n·$T_S$), where PAM_in(t) may represents a continuous-time function of the input signal PAM_in, and PAM_in[n] represents a discrete-time sequence of the input signal PAM_in. The sampling time instant $T_S$ for the sampling sub-module 3200 may be equal to the pulse cycle $T_{cycle}$, i.e., $T_{cycle}=T_S$, which means that a sampling rate $R_S$, where $R_S=1/T_S=1/T_{cycle}$, of the sampling sub-module 3200 is the same as the pulse rate. Thus, the sampling sub-module 3200 would obtain one sample PAM_in[n] within the n-th pulse cycle. In an embodiment where signal AD_in is in digital format, the input signal PAM_in may be the same as the audio input signal AD_in.

Figure 4:
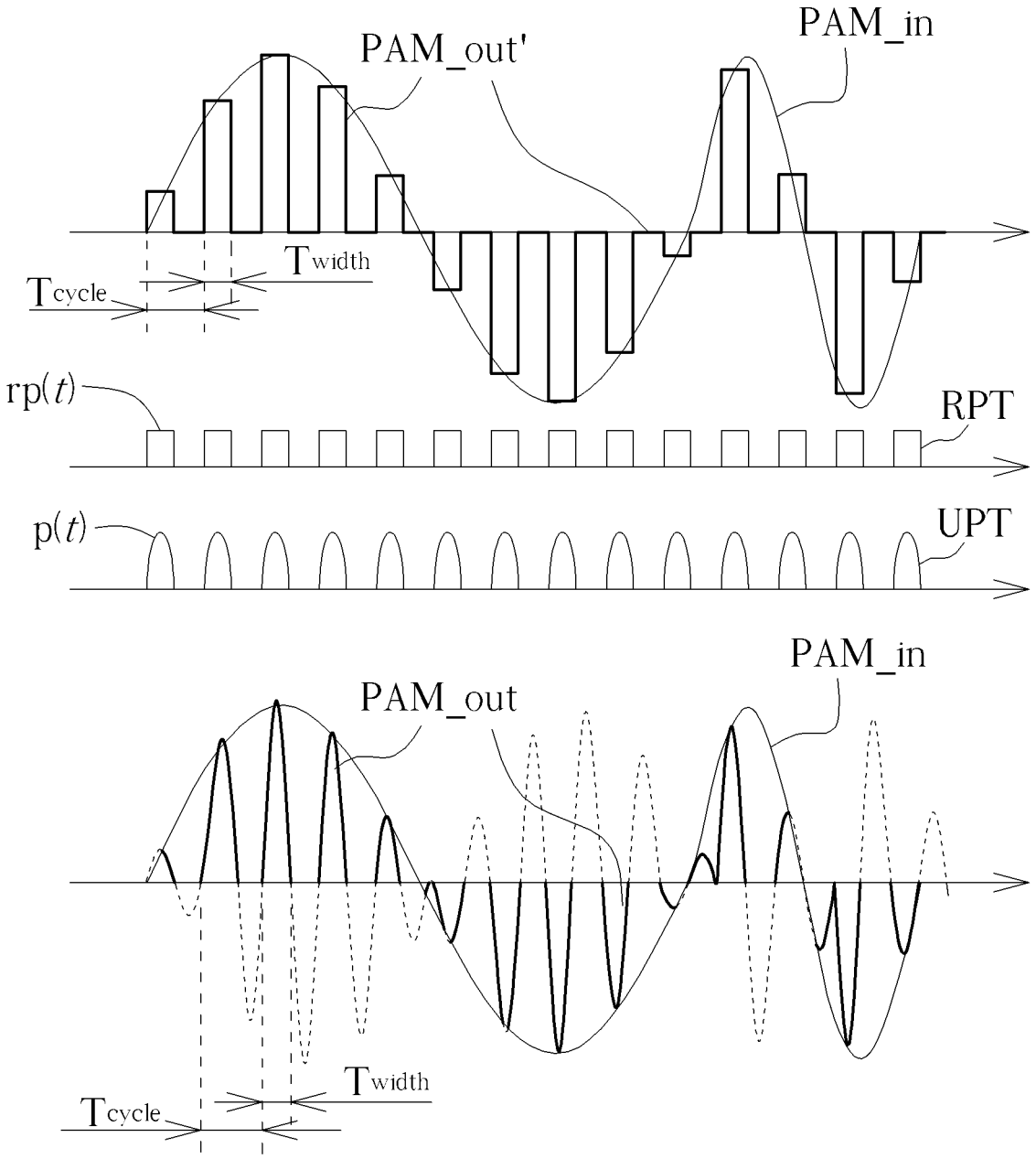
FIG. 4 is a schematic diagram of a plurality of signals according to an embodiment of the present invention.
Figure 5:
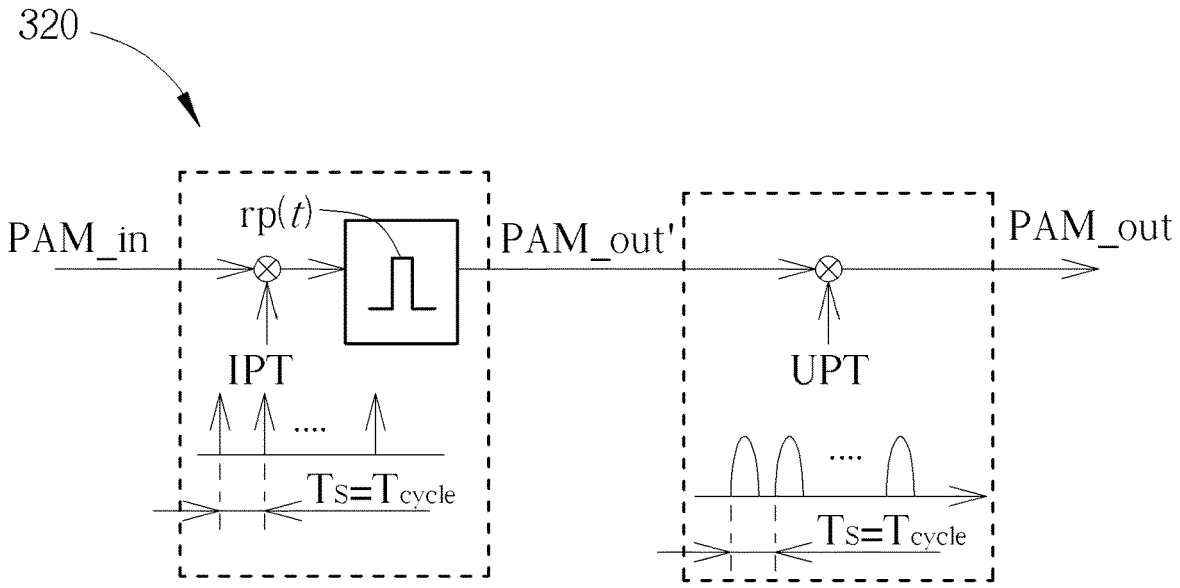
FIG. 5 illustrates a schematic model of a pulse amplitude modulation (PAM) module according to an embodiment of the present invention.

In an embodiment, the sampling sub-module 3200 may purely obtain the samples PAM_in[n] (hereafter, "sampling operation"). In the embodiment illustrated in FIG. 5, in addition to obtaining the samples PAM_in[n], the sampling sub-module 3200 may apply a plurality of rectangular pulses to the samples PAM_in[n] (hereafter, "holding operation"), to obtain an output signal PAM_out', as illustrated in FIG. 4 and FIG. 5. In signal analysis perspective, the sampling sub-module 3200 is equivalent to perform a time-domain multiplication of the input signal PAM_in with an impulse train IPT (i.e., the sampling operation) and perform a time-domain convolution on the multiplication result with an impulse response with the rectangular pulse rp(t) (i.e., the holding operation), as illustrated in FIG. 4 and/or FIG. 5. Specifically, a convolution of the impulse train IPT and the rectangular pulse rp(t) illustrated in FIG. 5 would result in a rectangular pulse train RPT illustrated in FIG. 4. In time-domain representation, the output signal PAM_out' may be mathematically expressed as PAM_out'(t)=/$\Sigma_n$ PAM_in[n]rp(t−n$T_S$). The rectangular pulse rp(t) may be expressed, for example, as rp(t)=1 for $0 \le t \le T_{width}$ and rp(t)=0 for $t > T_{width}$ or t<0, where $T_{width}$ represents a pulse width, a time-wise width when the pulse (e.g., rp(t) or p(t) later on) is greater than a specific value ε>0.

In an embodiment, the output signal PAM_out' with rectangular pulses can be directly used as the output signal PAM_out or AD_out. However, the frequency response of the rectangular pulse, i.e., the sinc function, suffers from its large sidelobe.

To further suppress the sidelobe brought by the rectangular pulse, the pulse shaping sub-module 3202 may apply a specific pulse shape p(t) to the samples PAM_in[n] or the output signal PAM_out' with rectangular pulses, where the specific pulse shape p(t) may be, for example, nonzero for $0 \le t \le T_{width}$ and be zero for $t > T_{width}$ or t<0. The specific pulse shape p(t) may be corresponding/proportional to a sine/cosine window, a raised cosine window, a Hann window, a Hamming window, a Blackman window, a Nuttall window, a Blackman-Nuttall window, a Blackman-Harris window, a Rife-Vincent window, a Gaussian window, a confined/truncated Gaussian window, a Slepian window, a Kaiser window and the likes. In an embodiment, the specific pulse shape p(t) may have unit energy.

Similarly, in signal analysis perspective, the pulse shaping sub-module 3202 is equivalent to perform a time-domain multiplication of the input signal PAM_out' with a unit pulse train UPT, as illustrated in FIG. 4 and FIG. 5, resulting in a frequency-domain convolution of PAM_out'(f) and UPT(f), where PAM_out'(f) and UPT(f) represent frequency response of the output signal PAM_out' and the unit pulse train UPT, respectively. In time-domain representation, the unit pulse train UPT may be mathematically expressed as UPT (t)=$\Sigma_n$ p(t−n·$T_S$), and the output signal PAM_out may be mathematically expressed as PAM_out(t)=$\Sigma_n$ PAM_in[n] ·p(t−n·$T_S$).

The pulse shaping sub-module 3202 may be in form of database storing the high-resolution variations/values of the specific pulse shape p(t), or in form of filter to produce specific pulse shape p(t). The pulse shaping sub-module 3202 may produce the output signal PAM_out.

Figure 6:
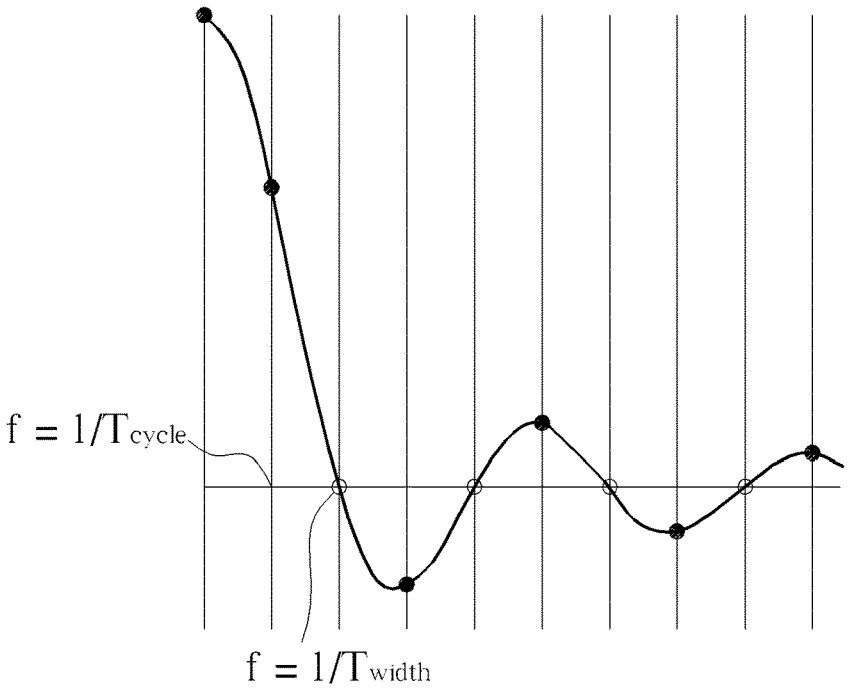
FIG. 6 illustrates a pulse frequency spectrum according to an embodiment of the present invention.

FIG. 6 illustrates a pulse frequency spectrum P(f), a Fourier transform of the pulse shape p(t). As can be seen from FIG. 6, the pulse frequency spectrum P(f) has zeros at multiples of (1/$T_{width}$), i.e., P(f)=0 when f=(k/$T_{width}$) for an integer k. In an embodiment, the pulse cycle $T_{cycle}$ may be chosen as a multiple of the pulse width $T_{width}$ i.e., $T_{cycle}$=m·$T_{width}$ for an integer m, and therefore the pulse frequency spectrum P(f) may automatically null out aliasing existing within RPT(f) and/or UPT(f) at f=(k/$T_{width}$). In an embodiment, m is chosen to be 2, i.e., m=2 and a duty factor DF for the RPT/UPT, defined as DF=($T_{width}$/$T_{cycle}$) is ½.

Figure 7:
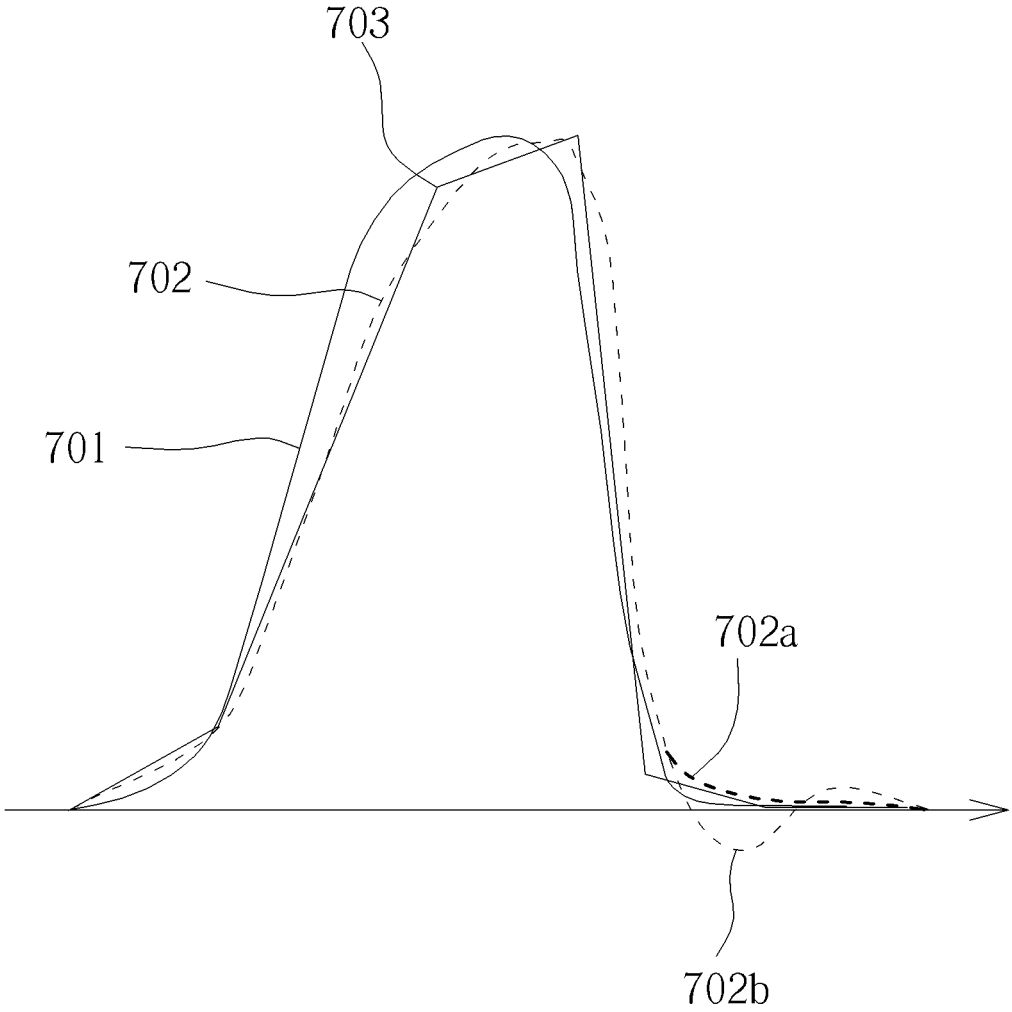
FIG. 7 illustrates various pulse shapes according to embodiments of the present invention.

In addition, the pulse shapes p(t) stated in the above embodiments are time-wise symmetric, e.g., p($T_{width}$/2+Δ)=p($T_{width}$/2−Δ) for $0 \le \Delta < T_{width}/2$, which is not limited thereto. Therefore, in an embodiment, the pulse shapes p(t) may be time-wise asymmetric, i.e., p($T_{width}$/2+Δ)≠p($T_{width}$/2−Δ) for $0 \le \Delta < T_{width}/2$. Inspired by U.S. application Ser. No. 16/125,761, certain time-wise asymmetry pulse shapes p(t) may result in large increases of SPL. For example, the pulse shapes p(t) may rise gently at a beginning of a pulse cycle, accelerate in the first half of the pulse cycle, achieve a maximum level, and decrease down to zero toward the end of the pulse cycle. Specifically, FIG. 7 illustrates various pulse shapes p(t), in which the curves 701-703 may be utilized as the pulse shape p(t). In addition, an overshoot may be accepted, as shown as a curve 702*b* at the end of the pulse cycle.

Furthermore, to suppress sidelobe phenomenon, the pulse frequency spectrum P(f) may be in form of P(f)=QSF(f)=(sin (f)/PL (f)) (eq. 1), where sin(f) is a sine function of f and PL(f) is a polynomial function of f. The polynomial function PL (f) may have zero coefficient for the constant term (i.e., $f^0$, the zero degree/order term) and has a coefficient as 1 for the linear term (i.e., $f^1$, the $1^{st}$ degree/order term). The polynomial function PL(f) can be expressed as PL(f)=f+$a_2f^2$+ . . . +$a_pf^p$. The function QSF(f) in eq. 1 may be called a quasi-sinc function. The function QSF(f) would approach the sinc function as f approaches 0, i.e., QSF(f)→sinc(f) as f→0, and the function QSF(f) would approach 0 as f approaches infinity, i.e., QSF(f)→0 as f→∞. The sinc function sinc(f) may be expressed as sinc(f)=sin (f)/f. The coefficients $a_2$-$a_p$ may be adjusted according practical situation. The curve 702*b* illustrated in FIG. 7 is an inverse Fourier transform of a quasi-sinc function QSF(f), i.e., p(t) may be in form of p(t)=IFT{QSF(f)}, where IFT{•} represents an inverse Fourier transform operator.

Figure 8:
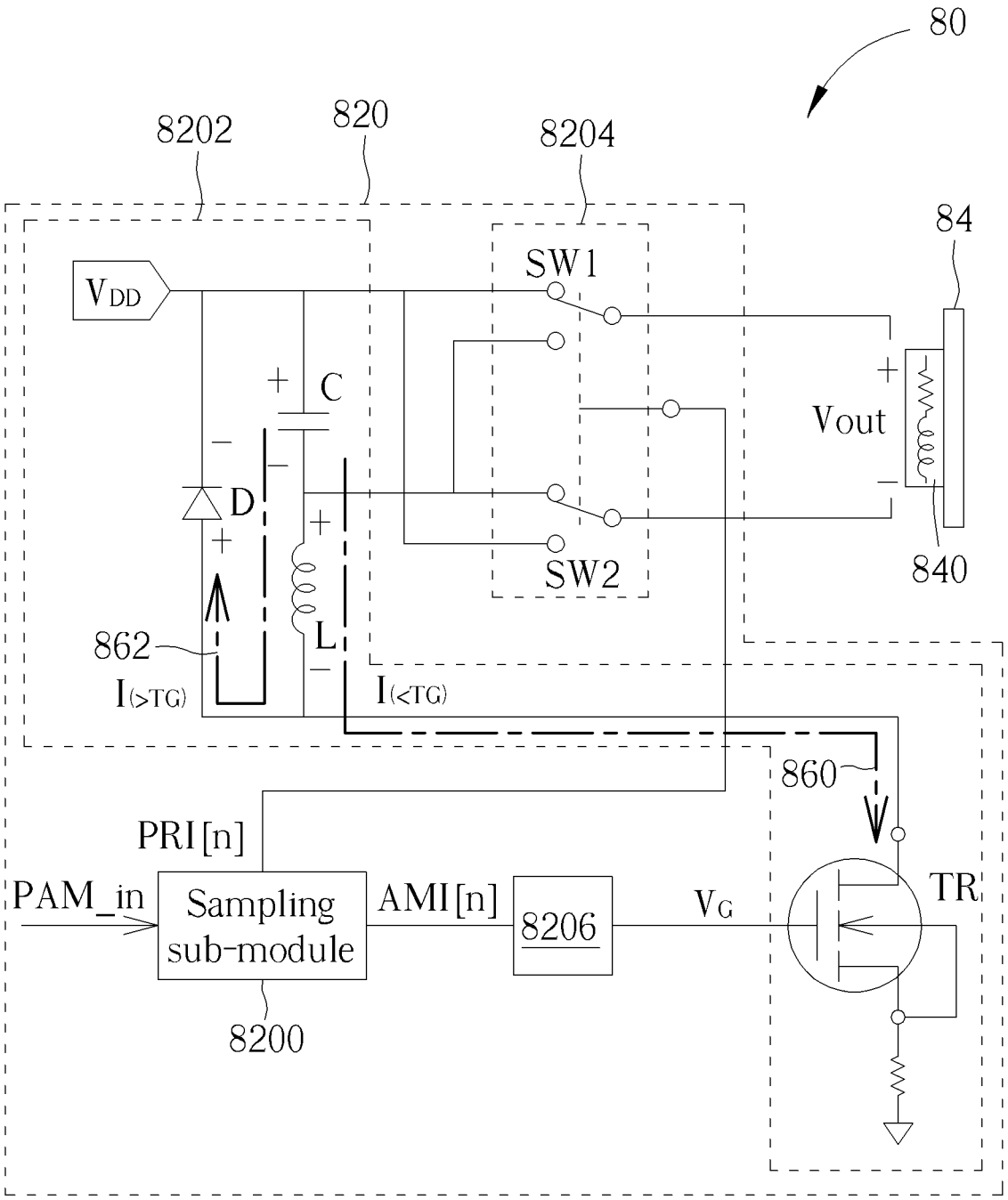
FIG. 8 is a schematic diagram of a sound producing apparatus according to an embodiment of the present invention.

As stated in the above, the pulse shaping sub-module may be in form of the filter, as illustrated in FIG. 8 by a schematic diagram of a sound producing apparatus 80 according to an embodiment of the present invention. Sound producing apparatus 80 comprises a PAM module 820 and a sound producing device 84. The PAM module 820 itself can be a realization of the driving circuit 12 in FIG. 1. The PAM module 820 comprises a sampling sub-module 8200, a pulse shaping filter 8202, a switching sub-module 8204 and a conductance-controlling signal generator 8206. The PAM module 820 is coupled to the sound producing device (load) 84, which may be a conventional tweeter with suitably wide high frequency extension. In FIG. 8, data conversion circuit (such as DAC and/or ADC) and buffering/power amplifier are omitted for brevity.

The sampling sub-module 8200 obtains the samples PAM_in[n] from the source PAM_in. Each sample PAM_in [n] comprises an amplitude information AMI[n] and a polarity information PRI[n], corresponding to the amplitude and the polarity of the n-th sampling time instant, respectively.

The pulse shaping filter 8202 comprises a transistor TR, a capacitor C, an inductor L and a low $V_{TH}$ diode D. As shown in FIG. 8 and as will be discussed below, the circuit topology of the pulse shaping filter 8202 is similar to which of a switching power supply, where high efficiency is achieved by current (I) steering interactions between active components, such as the transistor TR and the diode D, while utilizing low-loss reactive components, such as the inductor L and the capacitor C, as temporary energy storages.

The transistor TR, in the current embodiment, is an FET (field effect transistor), but not limited thereto. Controlled by conductance-controlling signal $V_G$, the transistor TR is turned to conduct current within a conducting period $T_G$ within a pulse cycle $T_{cycle}$. In an embodiment, the conducting period $T_G$ lies at a beginning of the pulse cycle $T_{cycle}$. In FIG. 8, the presence of current during conducting period $T_G$ is indicated as $I_{(L<TG)}$; the presence of current outside of conduction period $T_G$ is indicated as $I_{(t>TG)}$.

Figure 9:
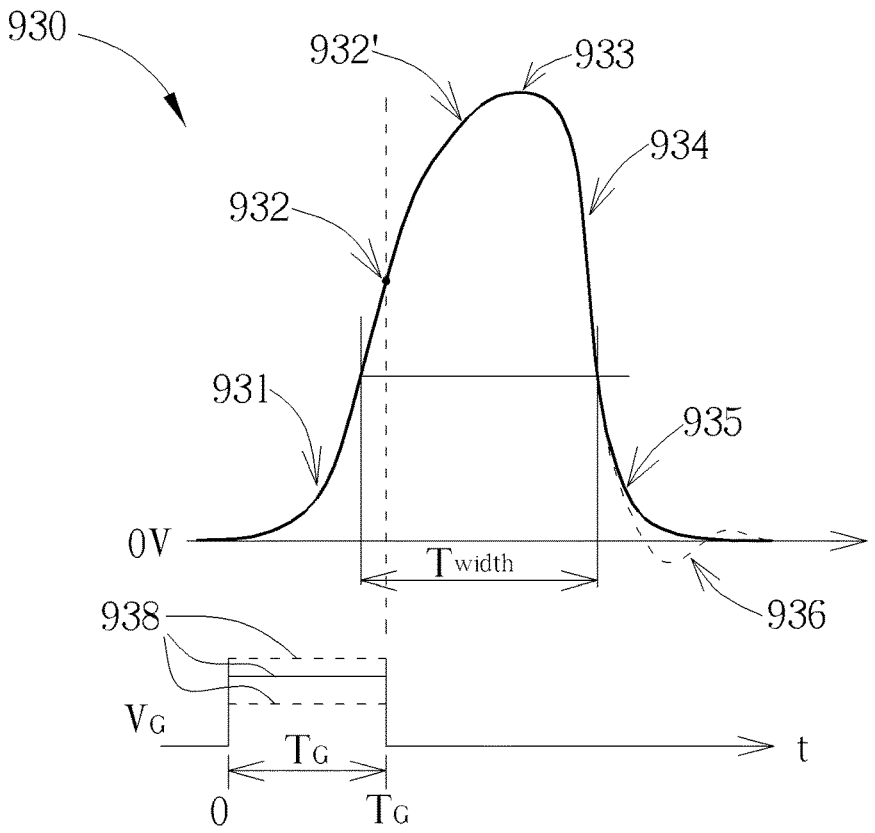
FIG. 9 illustrates a timing diagram of a conductance-controlling signal $V_G$ and a cross voltage $V_C$ over a capacitor C within the sound producing apparatus of FIG. 8.

FIG. 9 illustrates a timing diagram of the conductance-controlling signal $V_G$ and a curve 930 of a cross voltage $V_C$ over the capacitor C of FIG. 8. When the transistor TR is turned on and conducting during the conducting period, where time t satisfies $0<t<T_G$, the current $I_{(t<TG)}$ is drawn from $V_{DD}$ to ground through the path 860 (illustrated in FIG. 8), and the diode D is turned off by the negative bias across its electrodes. At the beginning of the cycle, when the time t is near 0, the capacitor C starts to be charged by the inductor L and, due to impedance of the inductor L, the voltage $V_C$ across capacitor C will rise slowly and the current flowing through the loading 840 of the sound producing device (load) 84 will be low when the time t is near 0. As the time t progresses, due to the interaction between the inductor L and the capacitor C, the cross voltage $V_C$ over the capacitor C would rise in a positive accelerating, as indicated by the rising slope of the portion 931 of the curve 930. As the current $I_{(<TG)}$ gradually increase, the slope of $V_C$ also increases until $t=T_G$, at that point the slope of curve 930 approaches maximum, as indicated by the point 932 on the curve 930.

When the transistor TR is cutoff at $t=T_G$, the current flow $I_{(t<TG)}$ is forced to 0. Due to the current-inertia of inductor L, same amount of current will instead flow through the path 862 (illustrated in FIG. 8), as $I_{(t>TG)}$ through the diode D to $V_{DD}$. The cross inductor voltage $V_L$ will be $V_L=-V_C-V_{TH}$ so that the diode D is turned ON to allow current $I_{(>TG)}$ to flow from the inductor L through the diode D to $V_{DD}$. At this time, due to the negative value of $V_L$, the magnitude of current $I_{(t>TG)}$ starts decreasing. Since the voltage $V_C$ across capacitor C is affected by both the current flowing through inductor L and the current flowing through the loading 840. The slope of $V_C$ will start to decrease, as indicated by a portion 932' of the curve 930. The cross voltage would then reach a peak 933. Subsequently, the slope of the cross voltage $V_C$ slope would turns negative, as indicated by the portion 934, and finally the voltage $V_C$ across capacitor C would fall toward 0V.

The last portion 935 or 936 is determined by the Q value of the LRC circuit formed between the inductor L, the capacitor C and the loading 840. The trailing portion of the curve can be either critical- or over-damped (Q<0.707) like the curve portion 935, or under-damped (Q>0.707) with ringing like the curve portion 936.

The curve 930 may be regarded as a kind of the pulse shape p(t) for the PAM module 820. By choosing suitable L-C component values, the tilting/asymmetry shape of the pulse shape of curve 930 may be exploited to enhance SPL of the sound producing apparatus 80.

Furthermore, the transistor TR of FIG. 8 may function as a programmable conductance device, controlled by a conductance-controlling signal $V_G$ generated by the conductance-controlling signal generator 8206. The conductance-controlling signal $V_G$ not only control the time when transistor TR is conducting, but also control the degree of conductivity, or resistance, of transistor TR during the conducting period, and such conductivity determines the magnitude of the current drawn from $V_{DD}$ flowing through path 860, comprising of C-L-TR. The conductance-controlling signal $V_G$ may be a square wave of varying magnitude levels, or amplitudes, where the magnitude levels relates to AMI[n] of the sampled signal at the $n^{th}$ sample time. For example, 938 of FIG. 9 shows three examples of different levels of $V_G$ (one magnitude level for one pulse cycle) controlling the conductance of MOS transistor TR of FIG. 8. The conductance-controlling signal generator 8206 generates the conductance-controlling signal $V_G$ of various magnitude levels 938 according to the amplitude information AMI[n]. The larger the amplitude information AMI[n], the larger magnitude level 938 in one pulse cycle would result in higher current being drawn from path 860 during conducting period and produces larger magnitude version of curve 930.

The switching sub-module 8204 comprises switches SW1 and SW2. The switches SW1 and SW2 are synchronously controlled by the polarity information PRI[n]. When the polarity information PRI[n] is positive, the switching sub-module 8204 and the switches SW1-SW2 would switch to a status that, a positive terminal of the capacitor C (annotated as "+") is coupled to a positive terminal of the load 84 (annotated as "+") through the switch SW1 and a negative terminal of the capacitor C (annotated as "−") is coupled to a negative terminal of the load 84 (annotated as "−") through the switch SW2. When the polarity information PRI[n] is negative, the switching sub-module 8204 and the switches SW1-SW2 would switch to a status that, the positive terminal of the capacitor C is coupled to the negative terminal of the load 84 through the switch SW2 and the negative terminal of the capacitor C is coupled to the positive terminal of the load 84 through the switch SW1.

Thus, an amplitude (or absolute value) of the pulse generated by the PAM module 820 depends on the amplitude information AMI[n] of the sample PAM_in[n], and a polarity of the pulse generated by the PAM module 820 depends on the polarity information PRI[n] of the sample PAM_in [n]. An output signal Vout of the PAM module 820 would be pulse amplitude modulated signal.

Compared to the pulse shaping sub-module 3202 which may be in form of data base storing high-resolution values of the specific pulse shape, in which high speed DAC probably is required, the PAM module 820 would achieve high efficiency due to its use of LC reactive components in a manner similar to switching power supply circuit.

Figure 10:
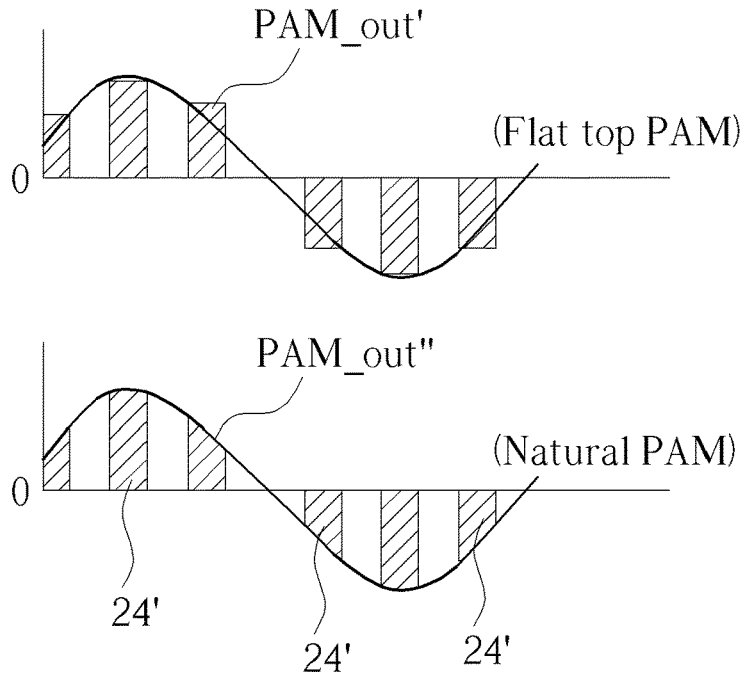
FIG. 10 illustrates schematic diagram of a flat top PAM and a natural PAM.

Referring back to FIGS. 3-5, the pulses within the output signal PAM_out' have flat top, which is regarded as flat top PAM, but not limited thereto. Natural PAM may be applied to the present invention as well. The flat top PAM and the natural PAM are schematically illustrated in FIG. 10. In natural PAM, the amplitude/envelope of each modulated pulse (within an output signal PAM_out") is directly proportional to which of the modulating signal (e.g., PAM_in) within the pulse width corresponding to that pulse. To achieve that (i.e., natural PAM), the PAM module may incorporate an up-sampling sub-module to produce an effective sampling rate higher than the pulse rate.

Figure 11:
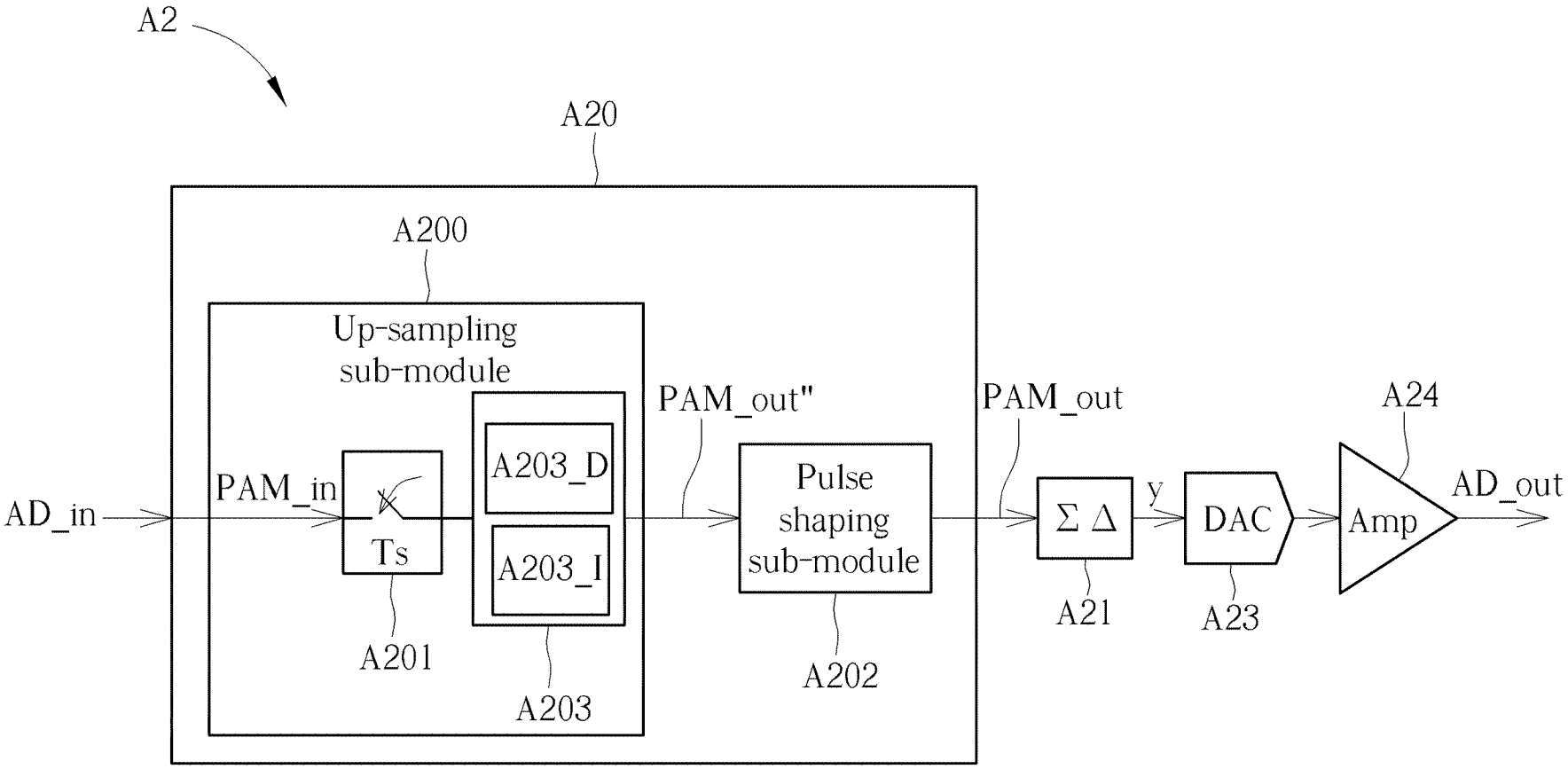
FIG. 11 is a schematic diagram of a driving circuit according to an embodiment of the present invention.

FIG. 11 is a schematic diagram of a driving circuit A2 according to an embodiment of the present invention. The driving circuit A2 comprises a PAM module A20, a sigma-delta module A21, a DAC A23 and a power amplifier A24. The PAM module A20 comprises an up-sampling sub-module A200 and a pulse shaping sub-module A202.

In the embodiment illustrated in FIG. 11, the up-sampling sub-module A200 may comprise a sampler A201 and a multi-rate processing circuit A203. The sampler A201 is configured to perform the sampling operation at an ordinary/source sampling rate, e.g., $R_S=1/T_S$, and obtain the (ordinary) samples PAM_in[n]. In an embodiment, the multi-rate processing circuit A203 may comprise a decimation filter A203_D and an interpolation filter A203_I, configured to perform a decimation operation and an interpolation operation, respectively, on the plurality of samples PAM_in[n]

with the sampling rate $R_S$, such that an equivalent/consequence sampling rate $R_S^{(up)}$ of an output signal PAM_out" (of the PAM module A20) is higher than the ordinary/source sampling rate $R_S$. The equivalent/consequence sampling rate $R_S^{(up)}$ may be M times of the sampling rate $R_S$, i.e., $R_S^{(up)}=M\cdot R_S=M/T_S$, for an integer M. In an embodiment, within the n-th pulse cycle, the up-sampling sub-module A200 may obtain a plurality of up-samples PAM_in[n, m], where the up-samples PAM_in[n, m] may be expressed, for example, as PAM_in[n, m]=PAM_in(t|t $n\cdot T_S+m\cdot(T_S/M)$) for m=0, 1, . . . , (M'-1) and M'≤M, where PAM_in(t) is the continuous-time function of the input signal PAM_in. In an embodiment, the value of $M'\cdot(T_S/M)$ may be equal to the pulse width $T_{width}$, i.e., $M'\cdot(T_S/M)=T_{width}$. When the M' is sufficiently large, e.g., M' may range from 16 to 128, the waveform of the output signal PAM_out" (of the PAM module A20) would look like the natural PAM illustrated in FIG. 10, assuming that the duty factor DF is less than 1. The output signal PAM_out" of the up-sampling sub-module A200 may be mathematically expressed as PAM_out"(t)=PAM_in(t)$\cdot(\Sigma_n rp(t-nT_S))$. Note that, an amplitude variation within each pulse 24' of the output signal PAM_out" (in the natural PAM) would reflect the corresponding source signal (e.g., the input signal PAM_in). Details of the decimation filter/operation and the interpolation filter/operation are known in the art, which is not narrated herein for brevity.

The pulse shaping sub-module A202 may store, in an embodiment, M' values of the specific pulse shape p(t). The pulse value p[m] may be expressed as p [m]=$p(m\cdot(T_S/M))$ for 0, 1, . . . , (M'−1). The operation of pulse shaping sub-module A202 may be equivalent to multiplying the pulse 24' of the output signal PAM_out" by the specific pulse shape p(t) in time domain, using the up-sampled PAM_in[n, m] and the pulse values p[m]. After applying the pulse shape on the output signal PAM_out" of the up-sampling sub-module A200, the output signal PAM_out of the PAM module A20 may be mathematically expressed as PAM_out (t)=PAM_in(t)$\cdot(\Sigma_n rp(t-nT_S))$, in terms of continuous-time function. Note that, the input signal PAM_in, the output signals PAM_out and PAM_out" shown in FIG. 11 may actually be digital signals in practice, which are exemplarily illustrated in continuous-time function in the above.

Assuming the signal(s) within the PAM module A20 of FIG. 11 operates in digital domain, the DAC A23 is necessary to convert the digital signals to be analog. In addition, the sigma-delta module A21 is coupled between the pulse shaping sub-module A202 and the DAC A23, configured to redistribute (residual) error energy over the entire pulse width $T_{width}$ (or M' in digital domain), such that the (residual) error energy would be evenly distributed over the entire pulse width $T_{width}$ (or M').

Figure 12:
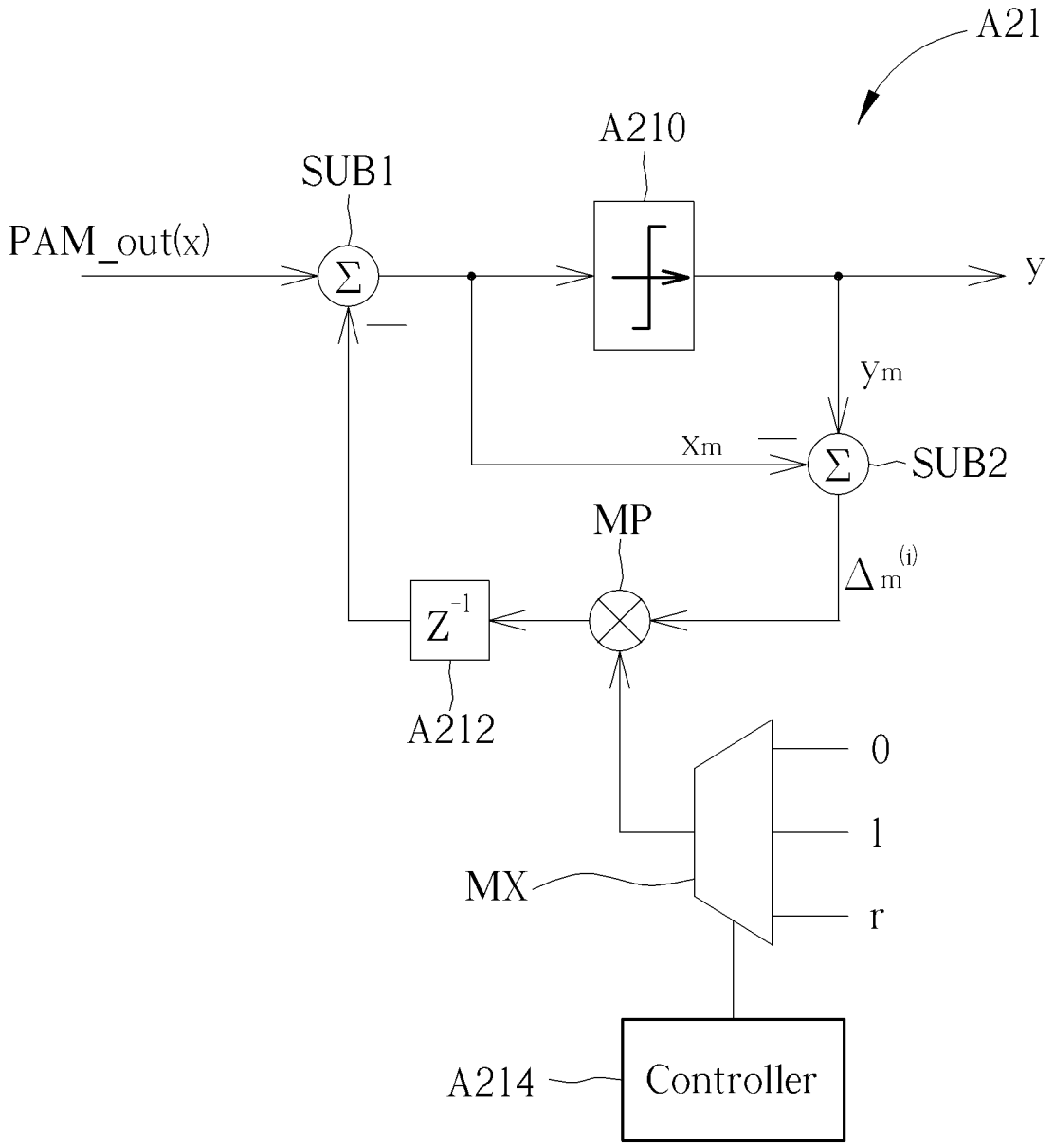
FIG. 12 is a schematic diagram of a sigma-delta module according to an embodiment of the present invention.

FIG. 12 is a schematic diagram of the sigma-delta module A21 according to an embodiment of the present invention. The sigma-delta module A21 is similar to the convention sigma-delta modules, which comprises subtractors SUB1, SUB2, a quantizer A210 and a delay element A212. Different from the convention sigma-delta modules, the sigma-delta module A21 further comprises a multiplier MP, a multiplexer MX and a controller A214.

The sigma-delta module A21 is an iterative sigma-delta module. In other words, the sigma-delta module A21 may perform several of iterations over one pulse period. For example, at a first iteration (i.e., i=1), the controller A214 may control the multiplexer MX such that an (initial) error $\Delta_m^{(1)}$ corresponding to the time instant at the beginning of one pulse is 0, i.e., $\Delta_m^{(1)}=0$ for m=0, and the error $\Delta_m^{(1)}$ of the rest time instants with the pulse is $\Delta_m^{(1)}=y_m-x_m$ for m=1, . . . , (M'−1), which is the same as conventional sigma-delta modules. For a second iteration (i.e., i=2), the controller A214 may control the multiplexer MX such that an error $\Delta_m^{(2)}$, corresponding to the time instant at the beginning of the pulse, i.e., $\Delta_0^{(2)}$, is related to $\Delta_{M'-1}^{(1)}$, the error corresponding to the last time instant of the first iteration. In short, the controller A214 may control the multiplexer MX such that the initial error $\Delta_{m=0}^{(2)}$ for the second iteration may be $\Delta_0^{(2)}=r\Delta_{M'-1}^{(1)}$, where the ratio r may be less than 1. In an embodiment, the ratio r may be 0.5, but not limited thereto. The controller A214 may also control the multiplexer MX such that $\Delta_m^{(2)}=y_m-x_m$ for m=1, . . . , (M'−1), which is the same as the convention sigma-delta modules. For iterations afterward (i.e., i≥3), the controller A214 may control the multiplexer MX such that an error $\Delta_0^{(i)}$, is related to $\Delta_{M'-1}^{(i-1)}$, the error corresponding to the last time instant of the previous iteration, and $\Delta_m^{(i)}=y_m-x_m$ for m=1, . . . , (M'−1), which is the same as the convention sigma-delta modules. The iterative operation may end when $\Delta_m^{(i)}$ converges or when an iteration number reaches a predefine number. Then the sigma-delta module A21 would output $y_m$ corresponding to the latest iteration as an output y of the sigma-delta module A21 to the DAC A23.

In the iterative sigma-delta module, the error $\Delta_m$ would be initialized as 0 at the first place, which induce extra mismatch, and may raise $\Delta_m$ when m approaches (M'−1). Without the iterative sigma-delta module A21, the residual error $\Delta_m$ of previous pulse would be fed into the current pulse, which is unreasonable. With the iterative sigma-delta module A21, the (residual) error $\Delta_m$ may be redistributed evenly from m=0 to m=M'−1. Therefore, the dynamic range or the resolution of the DAC A23 can be efficiently used.

Note that, the output signal PAM_out' of the sampling sub-module 3200 with ordinary sampling rate $R_S$ would be distorted by the mainlobe of the ordinary sinc function (corresponding to the ordinary sampling rate $R_S$), in frequency domain, within the signal band (i.e., human audible band). In comparison, by the up-sampling sub-module A200, where the equivalent sampling rate is up to $R_S^{(up)}=M\cdot R_S$, the mainlobe of the sinc function (corresponding to the sampling rate $R_S^{(up)}$) in frequency domain has been widened by M times, and becomes almost flat within the signal band or the human audible band. Therefore, the source signal (e.g., the audio input signal AD_in) would be less distorted during the sampling process if the PAM module A20 with the up-sampling sub-module A200 is utilized to generate the PAM output signal.

In another perspective, the driving circuit 32 comprising the PAM module 320 is sufficient for high quality treble speaker(s) such as AST 2560 to produce full range audio sound, where the frequency response of which (AST 2560) is flat up to 40 KHz. However, not many treble speakers exhibit such high frequency response. Most treble speakers can only achieve flat frequency of 25-30 KHz. A modified version of the PAM methodology of the present invention, as illustrated in FIG. 13, may be applied to those treble speakers with lower maximum frequency responses.

Figure 13:
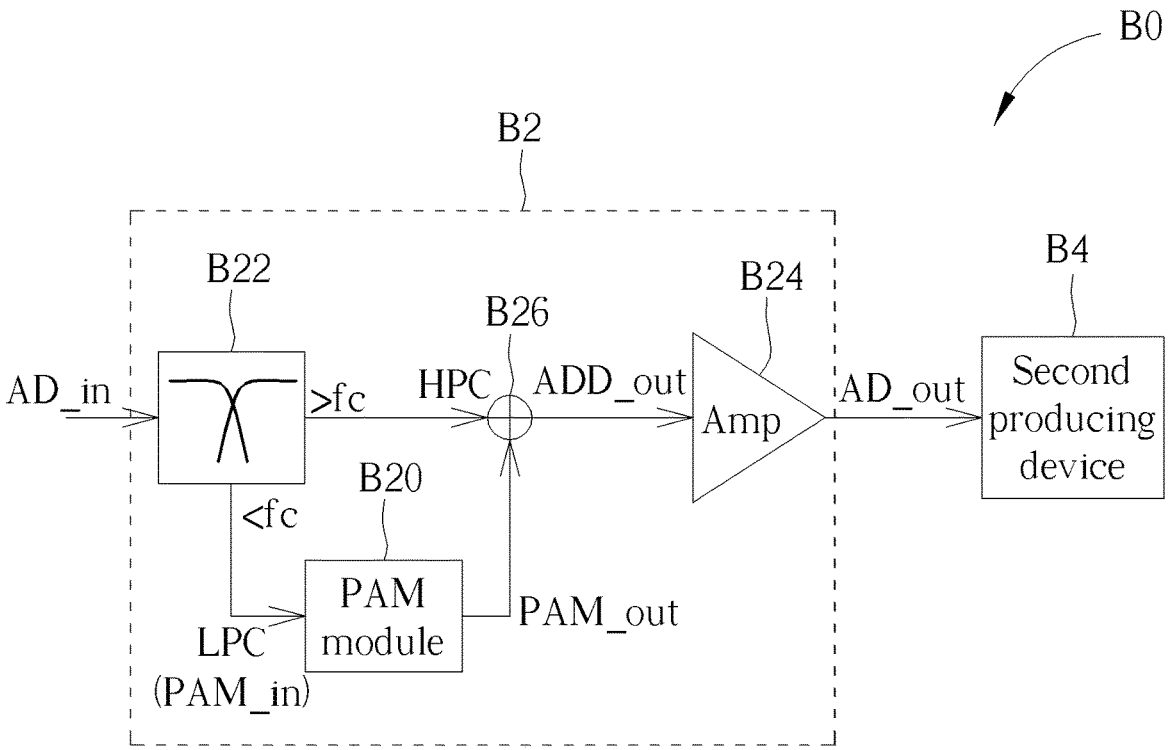
FIG. 13 is a schematic diagram of a sound producing apparatus according to an embodiment of the present invention.

FIG. 13 is a schematic diagram of a sound producing apparatus BO according to an embodiment of the present invention. The sound producing apparatus BO comprises a driving circuit B2 and a sound producing device B4. The sound producing device B4 may be an existing speaker(s) with a maximum frequency slightly higher than the maximum audible frequency, e.g., Dayton ND20FB-4. The driving circuit B2 comprises a PAM module B20, a crossover module B22, a power amplifier B24 and a summation unit (adder) B26.

Figure 14:
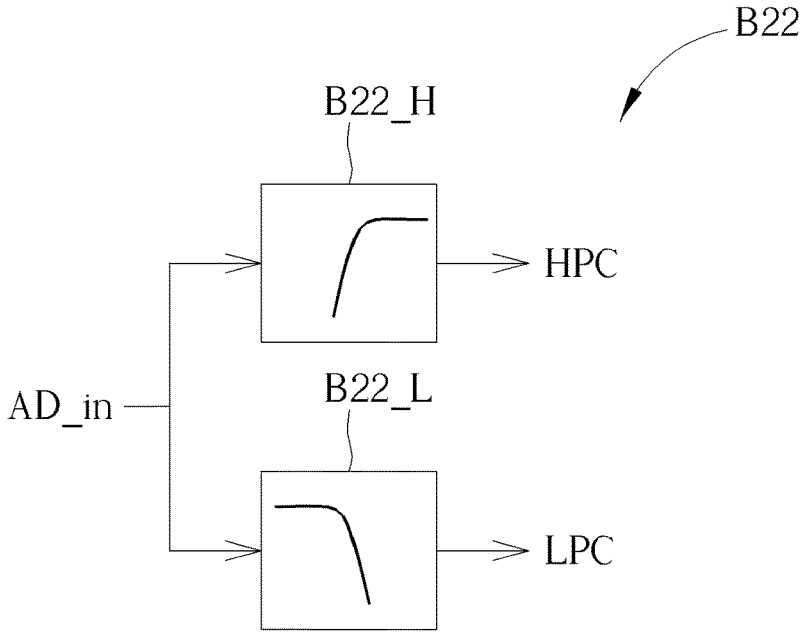
FIG. 14 is a schematic diagram of a crossover module according to an embodiment of the present invention.

The crossover module B22 comprises a matching pair of high pass filter B22_H and low pass filter B22_L, as shown in FIG. 14. The high pass filter B22_H and the low pass filter B22_L may have the same cutoff frequency $f_C$. The cutoff frequency $f_C$ may be at the middle of the audible frequency band. For example, the cutoff frequency $f_C$ may be between 3 KHz to 10 KHz. The crossover module B22 may receive the audio input signal AD_in. The high pass filter B22_H produces a high-pass component HPC, the signal component of the audio input signal AD_in beyond/above the cutoff frequency $f_C$, and the low pass filter B22_L produces a low-pass component LPC, the signal component of the audio input signal AD_in under/below the cutoff frequency $f_C$.

The low-pass component LPC, related to the audio input signal AD_in, is fed to the PAM module B20 and functions as the input signal PAM_in for the PAM module B20. The PAM module B20 performs PAM on the low-pass component LPC to generate the pulse amplitude modulated signal PAM_out. The PAM module B20 can be realized by one of the PAM module 320, 820, A20.

The adder B26 adds the pulse amplitude modulated signal PAM_out with the high-pass component HPC to generate output signal ADD_out, i.e., ADD_out=HPC+PAM_out. According to the output signal ADD_out, the power amplifier B24 may generate the output/driving signal AD_out of the driving circuit B2, to drive the sound producing device B4.

In other words, in driving circuit B2, the high-pass component HPC of the audio input signal AD_in is directly used to drive the sound producing device, and the low-pass component LPC is firstly PAM modulated and then used to drive the sound producing device. The driving circuit B2 utilizes the high-pass component HPC to compensate the deficiency of the sound producing device B4 (treble speaker) with insufficiently high maximum frequency. Therefore, the sound producing apparatus BO may still be able to produce sound in full audio frequency range.

Figure 15:
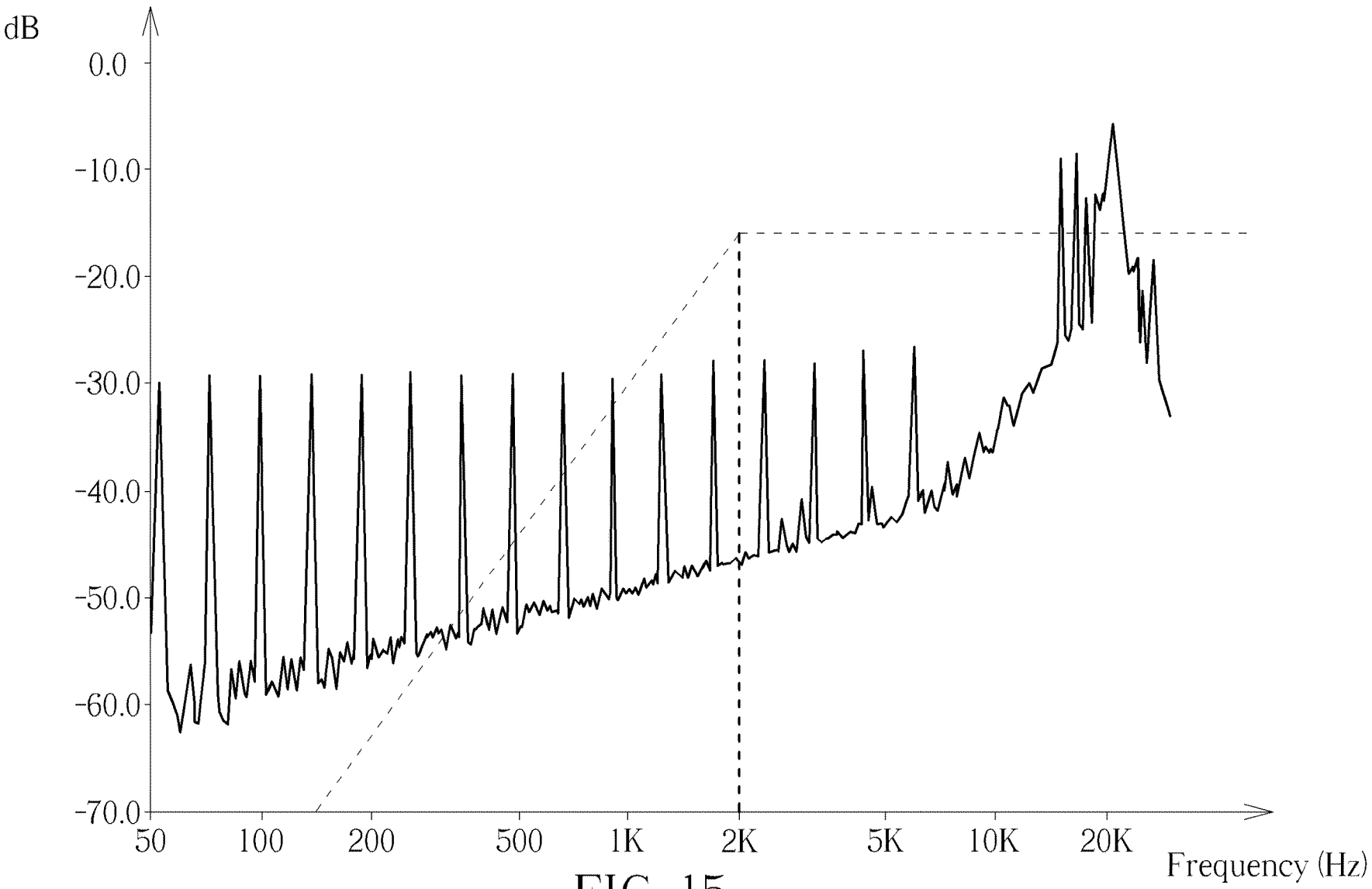
FIG. 15 illustrates output frequency response of sound producing apparatus.

FIG. 15 illustrates an experimentally measured frequency response of output (in terms of SPL) of the sound producing apparatus 10. Specifically, the solid line represents the experimentally measured frequency response of the sound producing apparatus 10 operating at a 21 kilo-pulse-per-second (Kpps) pulse rate. The tweeter Beston® RT002A, available for retail to DYI hobbyists, is adopted as the SPD 14. The input signal AD_in for the experiment comprises 16 sinusoidal signals/waves of equal amplitude with frequencies evenly distributed over 53 Hz to 6K Hz. Note that, the usable flat frequency response of Beston® RT002A when driven with conventional driving waveform is 2 KHz-40 KHz which is schematically illustrated as dashed line in FIG. 15. As can be seen from FIG. 15, the frequency response 2 KHz-40 KHz of Beston® RT002A is expanded to essentially flat frequency response over frequency 53 Hz to 6K Hz by utilizing the PAM driving waveform with the driving circuit (comprising the PAM module) of the present invention.

Note that, when the PAM-UPA scheme is applied, e.g., in the sound producing apparatus 10, by properly choosing the spring constant k of the SPD 14, it may have an effect that an effective maximum liner excursion of the SPD 14 is enlarged or even doubled, which is called "$X_{max}$ doubling" effect, where $X_{max}$ denotes a maximum linear excursion of the SPD 14, related to displacement of the SPD's coil (or membrane) from its neutral position.

The "$X_{max}$ doubling" effect is achieved by exploiting a restoring force Fr brought by the springing support mechanism present in the SPD 14, where the restoring force Fr can be expressed as $Fr=-k\cdot D$, where D represents a displacement of the membrane of the SPD 14. Note that, the restoring force Fr is proportional to the displacement and, as discussed in U.S. application Ser. No. 16/125,761, the displacement of PAM-UPA sound producing device is proportional to (1/f), where f is the frequency of the produced sound, i.e., $Fr\propto -D\propto(1/f)$ (eq-Fr). The net effect of eq-Fr is to produce a high-pass-filtering (HPF) effect with a corner/cutoff frequency $f_C$ in the SPL output of the SPD.

The virtue of high $X_{max}$ is known since it allows larger membrane displacement to produce higher output SPL or to extend bass to lower frequency. For a given $X_{max}$ the SPD 14 with the higher k will lead to higher Fr for a certain displacement D from the neutral position and for a given pulse period $t_{Pulse}$ and such higher Fr would produce a larger restoring displacement $D_{Fr}$, i.e., $D_{Fr}=\frac{1}{2}a\cdot t_{Pulse}^{2}\propto F_r$. Note that, due to the fact that $F_r\propto -D$, the direction of the restoring displacement $D_{Fr}$ is opposite to which of the displacement D. That is, the sign of $D_{Fr}$ is also the inverse of displacement D. In other words, the large restoring displacement $D_{Fr}$ would enlarge the effective $X_{max}$ and allow the SPD 14 to be able to tolerate more pulses pushing in the same direction without being saturated. As a result, for the PAM-UPA sound production scheme, if two SPDs have the same $X_{max}$ but different spring constant k, then the one with higher k may actually have better low frequency extension and dynamic range.

When the spring constant k of the SPD 14 is small, the $HPF_{Fr}$ effect caused by restoring force Fr is negligible and the corner frequency $f_C$ of $HPF_{Fr}$ will be very low. Under such circumstance an input signal level $HPF_{Sig}$ is required to prevent the SPD 14 from moving beyond $X_{max}$ to avoid the distortion from rising sharply and to prevent the destruction of the SPD 14. On the other hand, when the spring constant k of the SPD 14 is sufficiently high such that $f_C$ of the $HPF_{Fr}$ approaches $f_C$ of the $HPF_{Sig}$, the magnitude of Fr induced displacement $D_{Fr}$ would approach $X_{max}$ and the effective maximum linear excursion which can be defined as $X_{max}$ $D_{FR}$ would approach $2\cdot X_{max}$.

In a $1^{st}$ implementation, an audio system may apply a −6 dB/Octave high-pass filter on the audio input signal AD_in to lower the energy of audio signal component below a corner frequency $f_C$ of the high-pass filter ($HPF_{Sig}$), in order to prevent the SPD 14 from entering into a nonlinear region constrained by the $X_{max}$ of the SPD 14. In a $2^{nd}$ (preferred) implementation of sound producing apparatus 10, the spring constant k of the SPD 14 is purposely tuned such that the corner frequency $f_C$ of the k-induced $HPF_{Fr}$ effect of SPD is equal to the same $f_C$ as the prior ($1^{st}$) implementation using $HPF_{Sig}$ to filter the audio input signal AD_in, which is to prevent the SPD from entering into the nonlinear region constrained by X. of the SPD 14. In this case, the "$X_{max}$ doubling" effect would occur in the $2^{nd}$ implementation of apparatus 10 but not in the $1^{st}$ implementation. Note that, in the $1^{st}$ implementation, the $HPF_{Sig}$ is applied to the input signal while in the preferred $2^{nd}$ implementation, the $HPF_{Fr}$ would take effect when the unfiltered driving signal is applied to the SPD 14.

The "$X_{max}$ doubling" effect would allow the resulting PAM-UPA driven SPD, e.g., the sound producing apparatus 10, to enhance the power handling capability. For example, when the "$X_{max}$ doubling" effect occurs, the sound producing apparatus 10 may gain 6 dB in SPL while maintaining the same $f_{-3\ dB}$. Alternatively, the sound producing apparatus 10 may reduce the −3 dB frequency $f_{-3\ dB}$ by half and extend the bass operating frequency range while maintaining the same SPL level.

Instead of using the treble speaker, in an embodiment, the SPD 14 may be an MEMS (micro-electrical-mechanical-system) device.

Specifically, the MEMS SPD 14 can be a "position-based" sound producing device, where an actuator therein may deform when a driving voltage/signal is applied to an electrode of the actuator, e.g., applied across its top-electrode and bottom-electrode, such that the deformation of the actuator would cause the membrane thereof to deform, so as to reach a specific position, where the specific position of the membrane is determined by the driving voltage/signal applied to the an electrode of the actuator. Moreover, the specific position of the membrane is proportional to the driving voltage/signal applied to the an electrode of the actuator.

Figure 17:
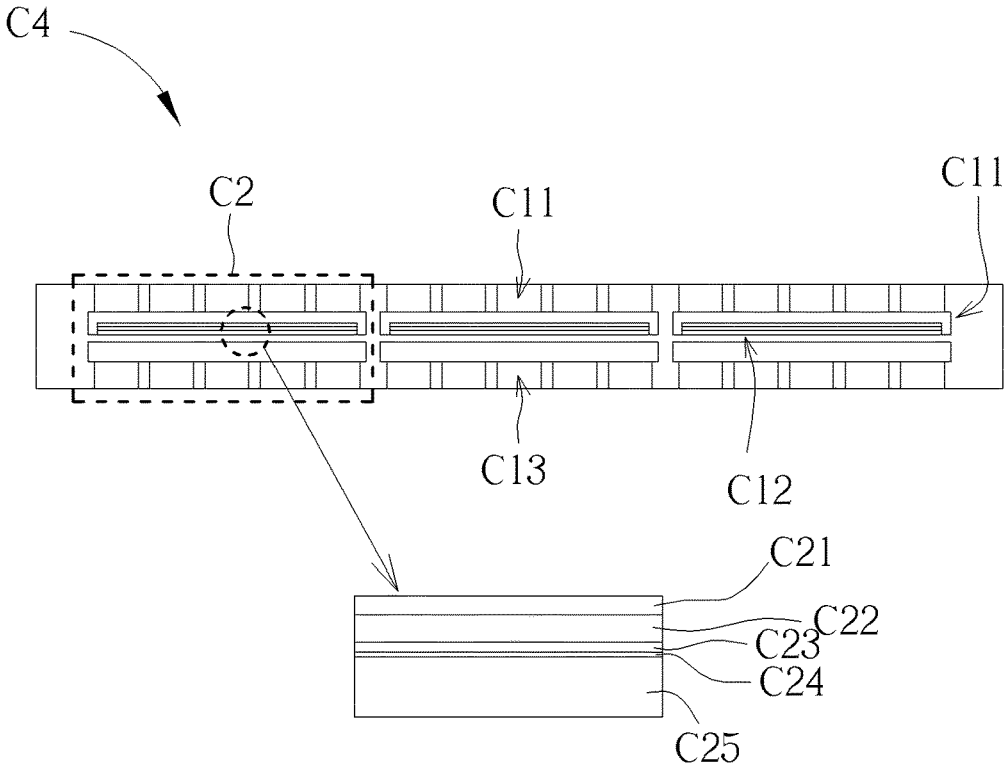
FIG. 17 is a cross sectional view of the sound producing device of FIG. 16 according to an embodiment of the present invention.

For a piezoelectric effect actuated actuator, the position of the membrane is determined by how much the actuator deforms, which is related to the product of the permittivity $d_{31}$ of the piezoelectric material and the driving voltage/signal applied across the top- and bottom-electrodes, e.g., the electrodes C21 and C23 illustrated in FIG. 17.

For the case of the SPD 14 being a "position-based" sound producing device, such as a piezoelectric force actuated MEMS device, the electrode 142 would drive actuator, which is layered over the membrane 140, to cause membrane 140 to move to a specific position according to the driving signal AD_out. Provided the response time of membrane movements is significant shorter than a pulse cycle time, such movements of the membrane 140 over a plurality of pulse cycles would produce a plurality of air pulses at an air pulse rate, which is the inverse of the pulse cycle time, e.g., $T_{cycle}$, where the air pulse rate is higher than a maximum human audible frequency. The said plurality of air pulses generated by the SPD 14 would each have a non-zero SPL offset, the amplitude of each air pulse and its non-zero offset being proportional to amplitudes of an input signal sampled at the said air pulse rate and the SPL associated with the plurality of air pulses may be aperiodic over a plurality of pulse cycles.

Figure 16:
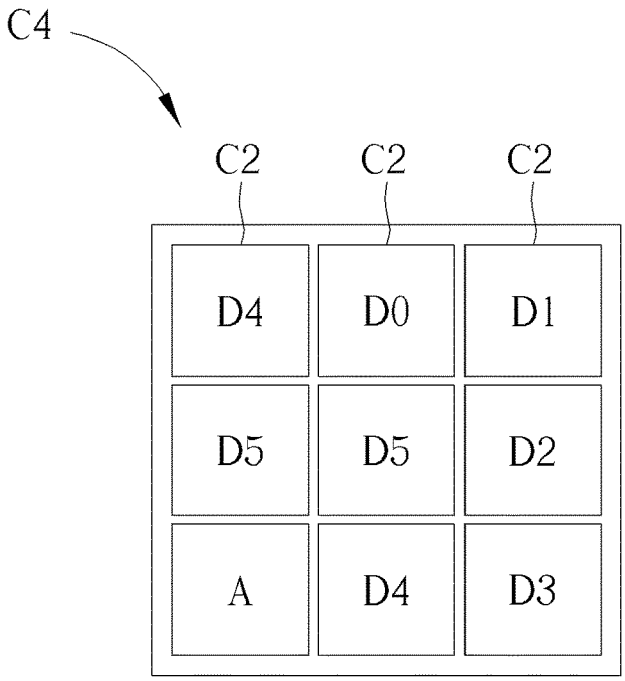
FIG. 16 is a top view of a sound producing device according to an embodiment of the present invention.

Details of the SPD 14 being the MEMS device and its corresponding driving circuit are described as follows. FIG. 16 is a top view of a sound producing device C4 according to an embodiment of the present invention. FIG. 17 is a cross sectional view of the sound producing device C4 according to an embodiment of the present invention. In this embodiment, sound producing device C4 may be a lead zirconate titanate ($PbZr_{(x)}Ti_{(1-x)}O_3$ or PZT) actuated MEMS device, which may be fabricated by an SOI (silicon on insulator) wafers with Si (silicon) thickness as 3~6 μm and a PZT layer of thickness of 1~2 μm, for example.

In the embodiment shown in FIG. 16 and FIG. 17, the sound producing device C4 may comprises a plurality of cells C2 (which are also annotated/labeled as D0-D5 and A), an optional front faceplate C11, an optional back faceplate C13. Each cell C2, as FIG. 17 shows, comprises a membrane layer C25, an actuator layer C22 comprising a piezoelectric layer C22, a top electrode layer C21 layered on top of piezoelectric layer C22, a bottom electrode layer C23 sandwiched between piezoelectric layer C22 and membrane layer C25. The piezoelectric cell membrane actuator C22 and the cell electrodes C21, C23 may be disposed on the cell membrane C25 through methods such as CVD/PVD sputtering or sol-gel spin coating, but not limited thereto. A cell driving voltage $V_D$ is applied between electrodes C21 and C23, to cause a deformation of the piezoelectric layer C22. When operating within its linear range, the actuator C22 deformation can be expressed as $\Delta D \propto \Delta V_D \cdot d_{31}$, where ΔD is the amount of deformation, $\Delta V_D$ is the change of applied voltage and $d_{31}$ is the permittivity of the piezoelectric material. Through the layered structure of FIG. 17, deformation of actuator C22 will cause cell membrane C25 to deform and result in its surface moving upwards or downwards.

In an embodiment optimized for high audio resolution, the cell driving voltages $V_D$ applied to the cells D0-D5, specifically named as the cell driving voltage $V_{D,\ D0}$~$V_{D,\ D5}$, may have a relationship approximately $|V_{D,\ D0}|$: $|V_{D,\ D1}|$: $|V_{D,\ D2}|$: $|V_D, D_3|$: $2 \cdot |V_{D,\ D4}|$: $2 \cdot |V_{D,\ D5}| \approx 2^0$: $2^1$: $2^2$: $2^3$: $2^4$: $2^5$ (eq. 2), such that the produced SPL of the cells D0-D5 have a relationship of $SPL_{D0}$:$SPL_{D1}$:$SPL_{D2}$:$SPL_{D3}$:$SPL_{D4}$:$SPL_{D5}$=$2^0$: $2^1$: $2^2$: $2^3$: $2^4$: $2^5$ (eq. 3).

In another embodiment, which is optimized for high output SPL, the cell driving voltage $V_{D,\ D0}$~$V_{D,\ D5}$, may have the same value, i.e. $|V_{D,\ D0}|=|V_{D,\ D1}|=|V_{D,\ D2}|=|V_{D,\ D3}|=|V_{D,\ D4}|=|V_{D,\ D5}|$ such that the SPL produced by each C2 cell will equal to ½·$SPL_{D5}$, where $SPL_{D5}$ is the SPL produced by the cells labeled as D5 of the previous example/embodiment.

In an embodiment, the cell driving voltages $V_D$ applied to the cells D0-D5 may be switch mode signals, i.e., binary signals, toggling between a high voltage $V_{max\text{-}DQ}$ and a low voltage $V_{min\text{-}DQ}$ where the index Q ranges from 0 to 5 and $V_{max\text{-}DQ}-V_{min\text{-}DQ}=V_{D,DQ}$. The cell driving voltage $V_D$ applied to the cell A may be multi-level signal generated by a DAC with any of the $2^R$ voltage levels uniformly distributed from $V_{min\text{-}A}$ to $V_{max\text{-}A}$ where R is the bits-per-sample resolution of the DAC and $V_{max\text{-}A}-V_{min\text{-}A}=V_{D,A}$.

The piezoelectric actuated sound producing device C4 is an example of "position-based" SPD, where the piezoelectric actuator C22 deforms under the voltage applied across the (top and bottom) cell electrodes C21 and C23, such deformation in turn causes deformation of Si cell membrane C25 and the position of the Si membrane changes as a result. For the position-based SPD to operate according to PAM-UPA scheme, the membrane movement response time constant $t_R$ of the membrane C25 should be significantly shorter than air pulse cycle time $T_{cycle}$, i.e. $t_R \ll T_{cycle}$ (eq. 4). When the condition of eq. 4 is satisfied, the sound pressure level $SPL_i$ produced within air pulse cycle i by the movement of membrane C25 can be expressed as $SPL_i \propto a_{Mbrn} \propto 2 \cdot \Delta P_i / t_R^2 \propto \Delta P_i \propto \Delta V_{Di}$ (eq. 5), where $a_{Mbrn}$ is the acceleration of membrane C25 when producing the air pulse associated with the certain air pulse cycle i, and $\Delta P_i$ is the movement (i.e., position difference) of membrane C25, $\Delta V_{Di}$ is the change of driving voltage during the pulse cycle $T_{cycle}$ corresponding to a certain air pulse i. Specifically, $\Delta P_i$ represents the position difference of membrane C25 from the $(i-1)^{th}$ pulse cycle to the $i^{th}$ pulse cycle, i.e. ΔP(i)=P(i)−P(i−1), and $\Delta V_{Di}$ represents the driving voltage difference from the $(i-1)^{th}$ pulse cycle to the $i^{th}$ pulse cycle, i.e. $\Delta V_D(i)=V_D(i)-V_D(i-1)$.

From eq. 5, it can be understood that, within the linear range of actuator C22, the $SPL_i$ of air pressure pulse i produced by the SPD C4 depends only on (or proportional to) the position change $\Delta P_i$ of membrane C25 during the pulse cycle $T_{cycle}$ or the driving voltage difference $\Delta V_{Di}$ applied to the electrodes C21 and C23 during the pulse cycle $T_{cycle}$ and this $SPL_i$ is independent of an initial/absolute position of membrane C25 or an initial/absolute voltage applied to the electrodes C21 and C23 at the beginning of air pressure pulse cycle i.

In other words, during each pulse cycle, the operation of a position-based PAM-UPA sound producing device based on the present invention can be summarized as $S(i) \propto SPL_i \propto \Delta P \propto \Delta V_D(i)$ where $\Delta V_D(i)$ denotes a voltage difference between a driving voltage $V_D(i)$ at time i and a driving voltage $V_D(i-1)$ at time (i−1), i.e., $\Delta V_D(i)=V_D(i)-V_D(i-1)$, S(i) denotes the (sampled) audio source signal at time i while $SPL_i$ denotes the sound pressure level corresponding to S(i).

In an embodiment, the SPD C4 may comprises $N_{cell}$ pulse generating cells C2, where some cells C2 are driven by switch mode signals, i.e., binary signals, while other cells C2 are driven by multi-level signals, i.e., M-ary signals, the displacement ΔP in eq. 5 will correspond to the sum of displacements made by all the $N_{cell}$ cells during one pulse cycle, i.e. $\Delta P=\Sigma_{c=1}^{Ncell}\Delta P_c$ and $\Delta V_D$ will correspond to the collective of driving voltages (may be different for each cell) suitable for generation of such ΔP.

Figure 18:
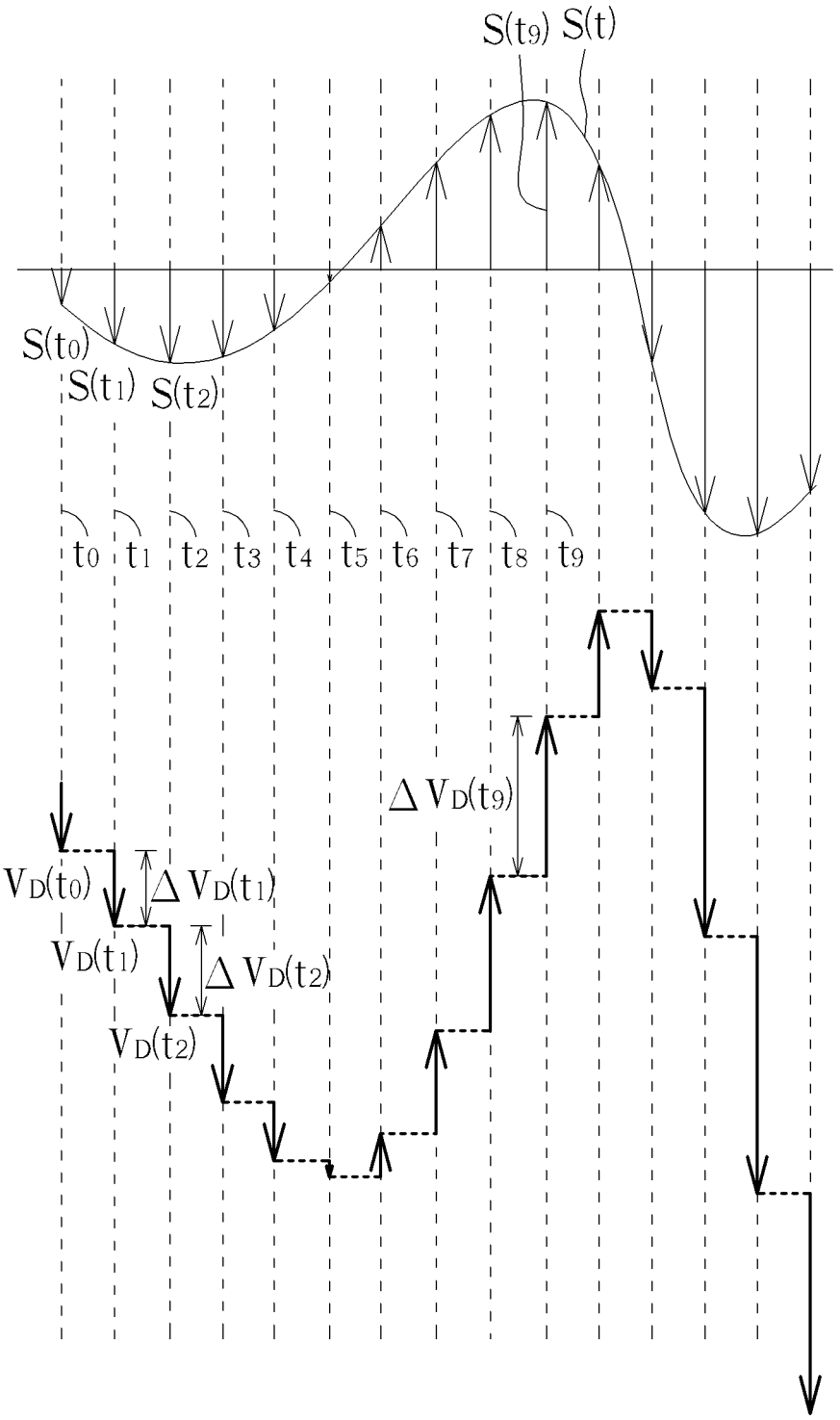
FIG. 18 illustrates waveforms of an audio input signal and a driving voltage.

FIG. 18 illustrates the waveform of an audio input signal S(t) and a driving voltage $V_D(t)$. For example, the audio input signal S(t) has samples $S(t_0)$-$S(t_9)$ at sampling time instants $t_0$-$t_9$, the driving voltage $V_D(t)$ has instantaneous value $V_D(t_0)$-$V_D(t_8)$ at the sampling time instants $t_0$-$t_8$, where $V_D(t_i)=V_D(t_{i-1})+\Delta V_D(t_i)$ and $\Delta V_D(t_i)=k\cdot S(i)$ for a constant k. Namely, the driving voltage $V_D(t_n)$ at time $t_n$ may be expressed by $V_D(t_n)=V_D(t_0)+\Sigma_{i=1}^{n}\Delta V_D(t_i)=V_D(t_0)+k\Sigma_{i=1}^{n}S(t_i)$ (eq. 6) for some initial time $t_0$.

Figure 19:
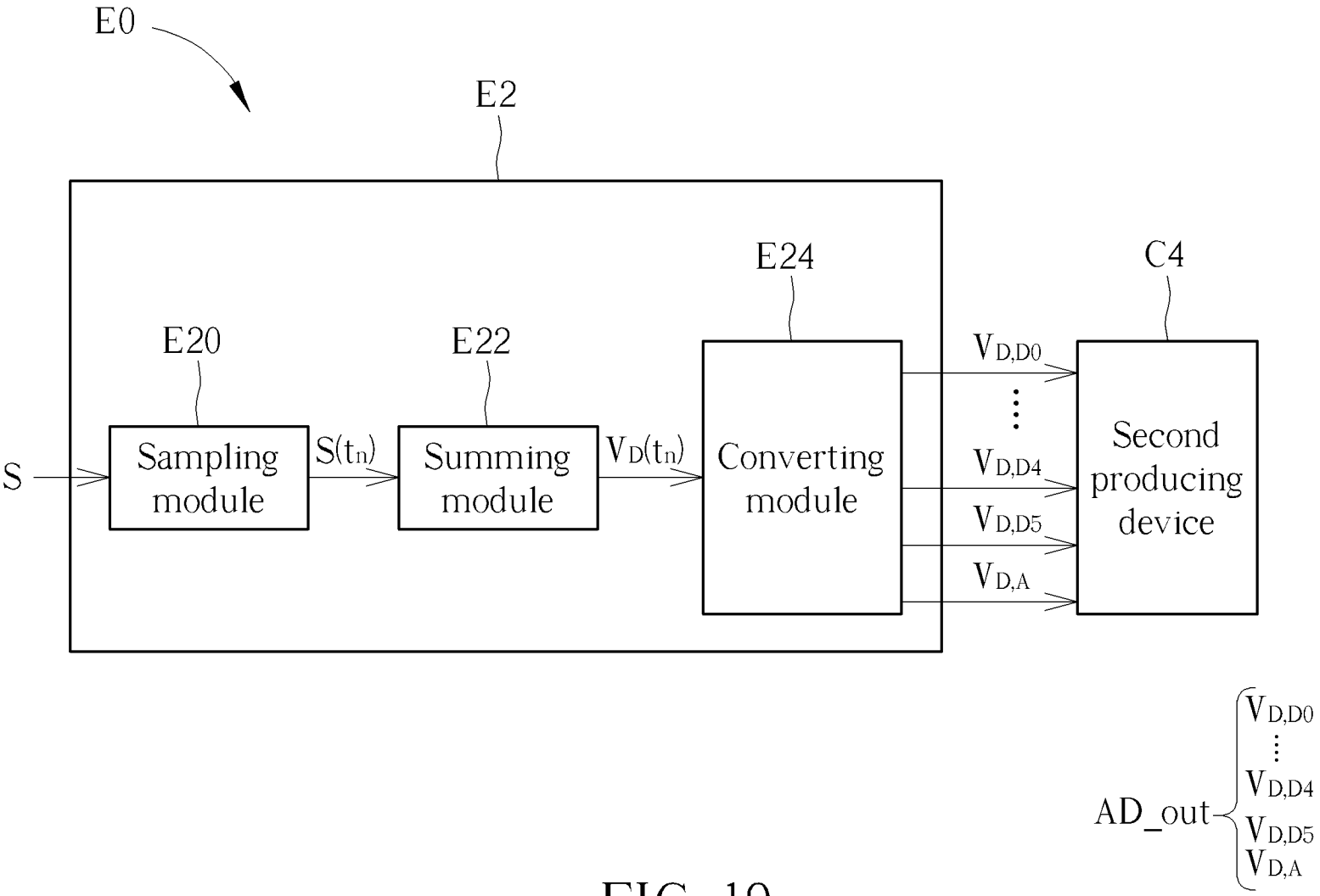
FIG. 19 is a schematic diagram of a sound producing apparatus according to an embodiment of the present invention.

FIG. 19 is a schematic diagram of a sound producing apparatus E0 according to an embodiment of the present invention. The sound producing apparatus E0 comprises a driving circuit E2 and the sound producing device C4. The driving circuit E2 receives the audio input signal S and configured to generate the driving signal AD_out comprising the cell driving voltages $V_{D,D0}$-$V_{D,D5}$ and $V_{D,A}$ for the cells D0-D5 and A within the sound producing device C4. The driving circuit E2 may comprise a sampling module E20, a summing module E22 and a converting module E24.

The sampling module E20 is configured to obtain the samples $S(t_0)$-$S(t_N)$ at the sampling time instants $t_0$-$t_N$, abbreviated as $S(t_n)$ in FIG. 19, where the sampling time instants $t_0$-$t_N$ may conform to a sampling rate $R_S=1/T_S$.

The summing module E22 is configured to obtain the driving voltage $V_D(t_0)$-$V_D(t_N)$ for position-based SPD corresponding to the sampling time instants $t_0$-$t_N$, abbreviated as $V_D(t_n)$ in FIG. 19, according to the samples $S(t_0)$-$S(t_N)$. In an embodiment, the summing module E22 may execute eq. 6 shown in the above, but not limited thereto, to obtain the driving voltage $V_D(t_n)$.

Note that it is often desirable to filter out ultra-low frequency components (such as below 30 Hz) to prevent SPD 14 from going into saturation. Further note that, summing module E22 has a frequency response of 6 dB/oct rising constantly toward 0 Hz. In an embodiment, the effect of a 6 dB/oct ultra-low-frequency filter with $f_C$=30 Hz and the summing module E22 can be realized by one single 6 dB/oct low-pass-filter with $f_C$=30 Hz. Variations of DSP steps as shown in this embodiment are known to well-trained DSP engineers and shall be considered as part of this present invention.

The converting module E24 is configured to generate the cell driving voltages $V_{D,D0}$-$V_{D,D5}$, $V_{D,DX}$ and $V_{D,A}$ according to the driving voltage $V_D(t_n)$. Based on eq. 2 and eq. 3, operations of the converting module E24 is similar to which of ADC or quantizer, where the cell driving voltage $V_{D,D5}$~$V_{D,D0}$ for the cell D5~D0 may be regarded as a value corresponding to most significant bits (MSB), and the driving voltage $V_{D,A}$ for the cell A may be regarded as a value corresponding/similar to least significant bits (LSB).

Use the cell structure of FIG. 16 driven in a SPL-optimizing scheme as an example, let driving voltages $\{V_{D,5}, V_{D,4}, V_{D,3}, V_{D,2}, V_{D,1}, V_{D,0}, V_{D,A}\}$ corresponding to cells {D5, D4, D3, D2, D1, A} has values of {0, 1, 0, 0, 0, 1, 7/128} in pulse cycle i and these values change to {1, 1, 0, 0, 0, 1, 63/128} in pulse cycle i+1 and produce a SPL value of spl_i as a result. Then, according to the method of this invention, the same spl_i can also be generate by $\{V_{D,5}, V_{D,4}, V_{D,3}, V_{D,2}, V_{D,1}, V_{D,0}, V_{D,A}\}$ transitions such as from {0, 0, 0, 0, 0, 0, 0/128} to {1, 0, 0, 0, 0, 0, 56/128} or from {0, 0, 0, 0, 0, 0, 72/128} to {1, 0, 0, 0, 0, 1, 0/128} or from {1, 0, 0, 0, 1, 1, 82/128} to {1, 1, 0, 1, 1, 1, 10/128}, etc.

Figure 20:
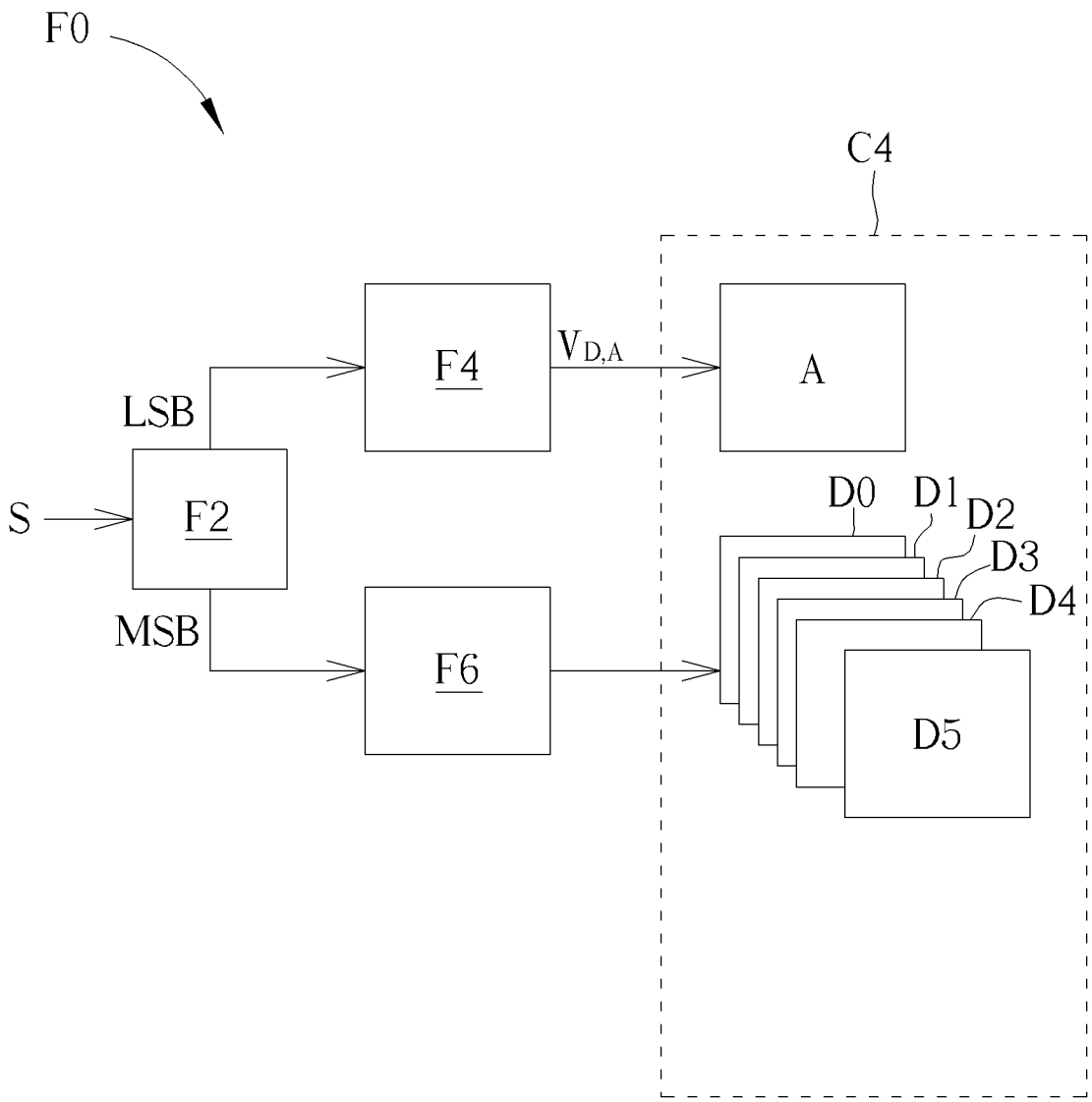
FIG. 20 is a schematic diagram of a sound producing apparatus F0 according to an embodiment of the present invention.

FIG. 20 is a schematic diagram of a sound producing apparatus F0 according to an embodiment of the present invention. Use the cell structure of FIG. 16 driven in a resolution-optimizing scheme as an example, the sound producing apparatus F0 may comprise a sampling-and-mapping module F2, a multi-level driver F4, a switch mode driver F6 corresponding to D5~D0 and the sound producing device C4. The multi-level driver F4 may be a 14 bit-per-sample (bps) DAC. The overall bit-per-sample resolution of sound producing apparatus F0 will be 14 bps (via F4) plus 6 bps (via F6), which would be 20 bps. In other words, the value that can be represented in F0 is 0~0xfffff (hex) and the driving voltages $V_D(t_n)$ produced according to eq. 6 above will need to be mapped to this value range of F0 by sampling-and-mapping block F2.

The switch mode driver F6 is coupled to the 5 most-significant-bits (MSB) of driving voltage $V_D(t_n)$ and it generates the cell driving voltages $V_{D,D0}$-$V_{D,D5}$ for the cells D0-D5 within the sound producing device C4. The DAC block F4 is coupled to the less-significant-bits (LSB) of driving voltage $V_D(t_n)$ to generate the cell driving voltages $V_{D,A}$ for the cell A within the sound producing device C4.

As discussed in U.S. application Ser. No. 16/125,761, in the UPA-PAM sound production scheme, given flat output SPL frequency response, the displacement D of the membrane versus frequency f has a relationship of $D \propto (1/f)$, which means that the lower the audio frequency f, the larger the displacement D. In addition, the displacement D of the membrane is constrained by the available range of excursion of the SPD. For example, in the example related to FIG. 20 described above, the range of excursion across the nine C2 cells of FIG. 16 corresponds to the value range 0~0xfffff (hex) of apparatus F0.

To prevent the SPD from clipping, i.e., distortion due to the saturation of the membrane displacement, appropriate high pass filtering/filter (HPF) may be needed.

Figure 21:
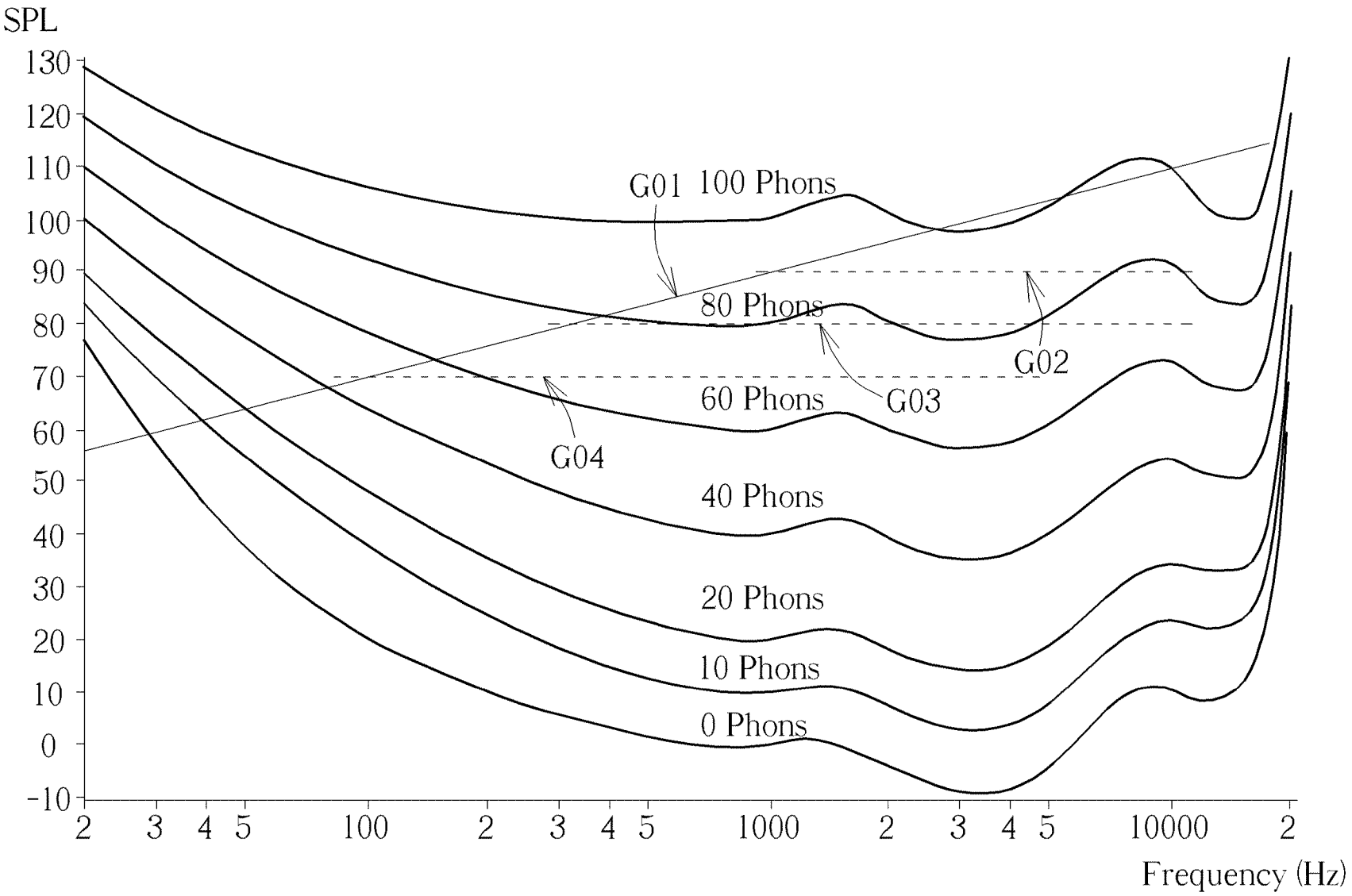
FIG. 21 illustrates contours of equal loudness and lines representing non-clipping SPL limit and corresponding SPL.

FIG. 21 illustrates contours of equal loudness (0 Phons, 10 Phons, 20 Phons, . . . , 100 Phons) and lines representing non-clipping SPL limit and corresponding SPL. Line G01 is an example of SPL limit for a certain embodiment of position-based MEMS SPD according to the present invention while guaranteeing non-clipping operation. Dashed lines G02-G04 represent 3 different SPL levels (90 dB, 80 dB, 70 dB) at which flat-frequency-response are maintained. Line G02 represents the flat frequency response above a cutoff frequency fc=1 KHz has SPL at 90 dB SPL; line G03 represents the flat frequency response above a cutoff frequency fc=316 Hz has SPL at 80 dB; line G04 represents the flat frequency response above a cutoff frequency 100 Hz has SPL at 70 dB. As shown in FIG. 21, for a given MEMS SPD operating according to the present invention, there is a tradeoff between cutoff frequency and the SPL of the flat frequency response above the cutoff frequency. Choosing any one of these cutoff frequencies and their corresponding non-clipping SPL-limit curves G02~G04 for the HPF (to prevent clipping) would involve sacrificing either the flat response SPL or the cutoff frequency $f_C$. In addition, such HPF with fixed decay slope (e.g. −6 dB/oct toward low frequency) and corner frequency $f_C$ is designed to guarantee non-clipping operation based on the worst case audio source input scenarios which leads to over-filtering under most circumstances. Low frequency component of the audio input signal would be filtered out by such HPF, regardless of whether the overall audio signal would cause actual clipping or not.

Figure 22:
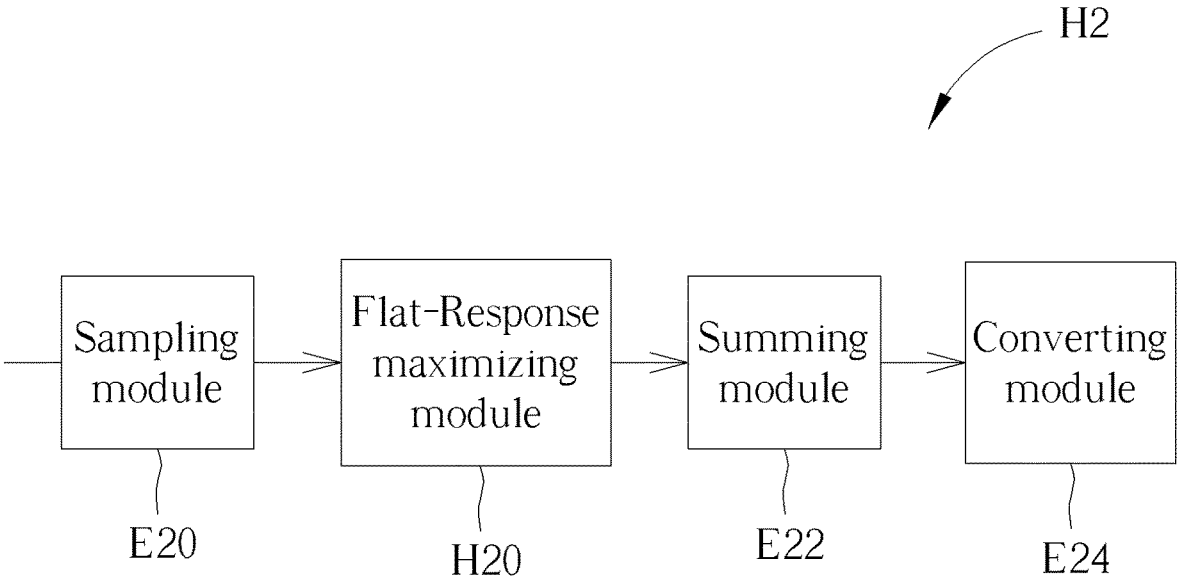
FIG. 22 is a schematic diagram of a driving circuit according to an embodiment of the present invention.

To overcome the deficiency stated above, the driving circuit 12 of FIG. 1 may incorporate a flat-response maximizing module, such as H20 of FIG. 22, to achieve maximumly flat (i.e. as close to being flat as possible) frequency response. The maximumly flat frequency response may be achieved by adaptively adjusting the signal processing chain/parameter based on real-time interaction of input data and the operation of the MEMS SPD.

FIG. 22 is a schematic diagram of a driving circuit H2 according to an embodiment of the present invention. The driving circuit H2 is similar to the driving circuit E2, and thus, the same components are denoted by the same notations. Different from the driving circuit E2, the driving circuit H2 further comprises a flat-response maximizing module H20, coupled between the sampling module E20 and the summing module E22. The flat-response maximizing module H20 receives the plurality of samples $S(t_n)$ of the audio input signal S(t), and generates a plurality of processed samples $S(t_n)^{(P)}$ according to the plurality of samples $S(t_n)$.

Figure 23:
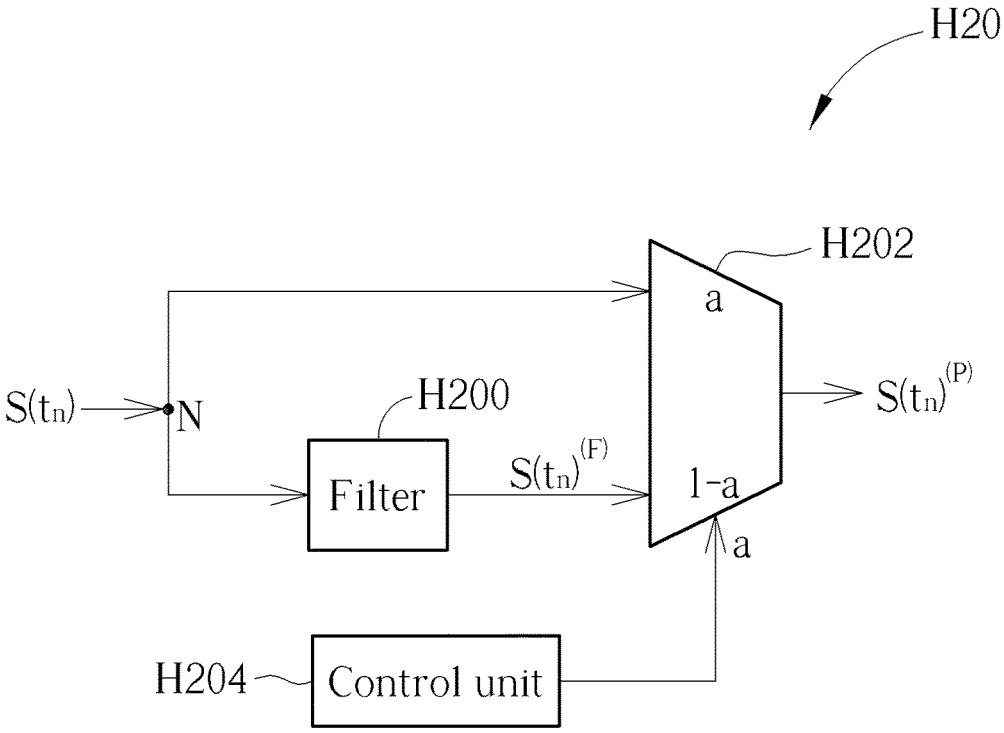
FIG. 23 is a schematic diagram of a flat-response maximizing module according to an embodiment of the present invention.

FIG. 23 is a schematic diagram of the flat-response maximizing module H20 according to an embodiment of the present invention. The flat-response maximizing module H20 comprises a first filter H200, a mixing sub-module H202 and a control unit H204.

The first filter H200, coupled to a first node N, may be an HPF, configured to perform a first high pass filtering operation on the samples $S(t_n)$ and generate a plurality of filtered samples $S(t_n)^{(F)}$ according to the samples $S(t_n)$. The first high pass filtering operation may be corresponding to a first cutoff frequency $f_{c1}$ and approximately −6 dB/octave degradation below the cutoff frequency $f_{c1}$. The cutoff frequency $f_{c1}$, for example, may be 1 KHz, as illustrated in FIG. 21 by the intersecting point between G01 and G02.

The mixing sub-module H202 comprises a first input terminal coupled to the first filter H200 and a second input terminal coupled to the first node N. The mixing sub-module H202 is configured to perform a linear combination (i.e., the mixing operation) of the samples $S(t_n)$ and the filtered samples $S(t_n)^{(F)}$, according to a ratio coefficient a, where $0 \le a \le 1$, such that an output terminal of the mixing sub-module H202 outputs the processed samples $S(t_n)^{(P)}$ as $S(t_n)^{(P)}=a \cdot S(t_n)+(1-a) \cdot S(t_n)^{(F)}$. The mixing sub-module H202 can be simply realized by two multipliers to implement the operations of $a \cdot S(t_n)$ and $(1—a) \cdot S(t_n)^{(F)}$ and one adder to implement the operation of $a \cdot S(t_n)+(1-a) \cdot S(t_n)^{(F)}$. To minimize abnormalities caused by phase shift between the inputs to the mixing sub-module H202, filter H200 may be realized by 0-phase FIR technique.

The control unit H204, coupled to the mixing sub-module H202, is configured to compute the ratio coefficient a. The control unit H204 may be realized by MCU (Microcontroller), ASIC (Application-Specific Integrated Circuit), DSP (Digital signal processor), or other computing device, which is not limited thereto. In an embodiment, the control unit H204 may be coupled to an output terminal of the summing module E22 to determine whether the driving voltage $V_D$ is about to be clipped by the sound producing device C4. If the control unit H204 determines that the driving voltage $V_D$ is about to be clipped, the control unit H204 would adjust the ratio coefficient a lower, which means that the clip-preventing operation (done by the first filter H200) becomes more significant within the processed samples $S(t_n)^{(P)}$. If the control unit H204 determines that the driving voltage $V_D$ is far from being clipped, the control unit H204 would adjust the ratio coefficient a higher, which means that the unfiltered (original) samples $S(t_n)$ becomes more significant within the processed samples $S(t_n)^{(P)}$. In an embodiment, the first cutoff frequency $f_{c1}$ may be determined by the control unit H204 as well.

Figure 24:
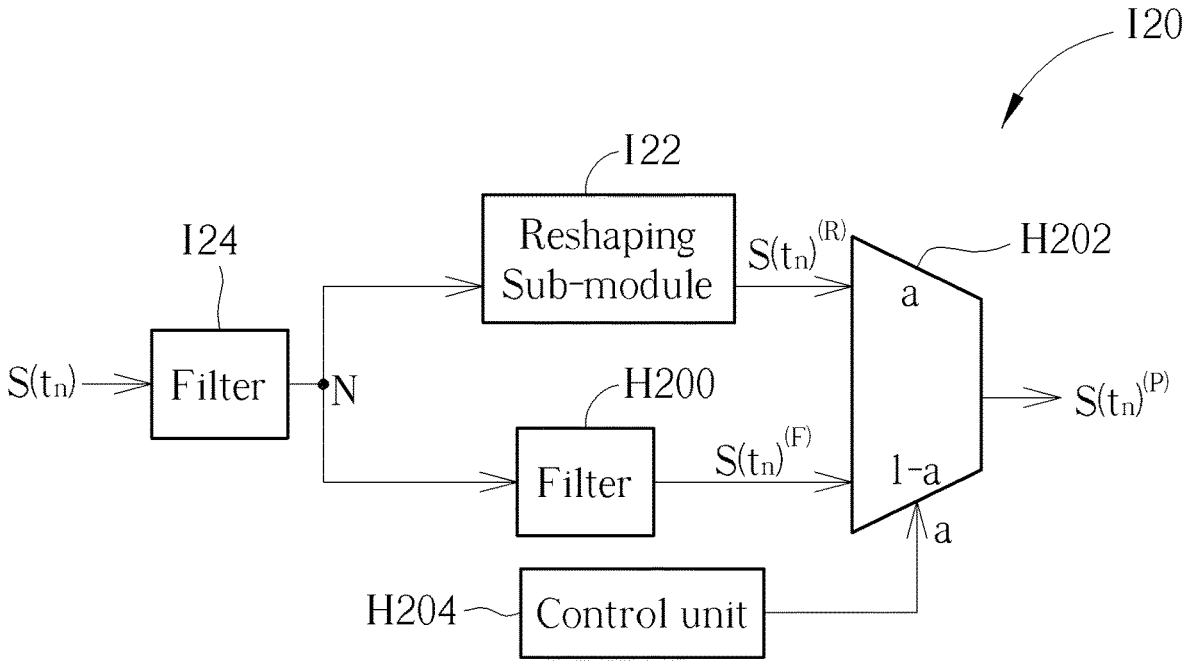
FIG. 24 is a schematic diagram of a flat-response maximizing module according to an embodiment of the present invention.

FIG. 24 is a schematic diagram of the flat-response maximizing module I20 according to an embodiment of the present invention. The flat-response maximizing module I20 is similar to the flat-response maximizing module H20, and thus, the same components are denoted by the same notations. Different from the flat-response maximizing module H20, the flat-response maximizing module I20 further comprises a reshaping sub-module I22 and a second filter I24.

Figure 25:
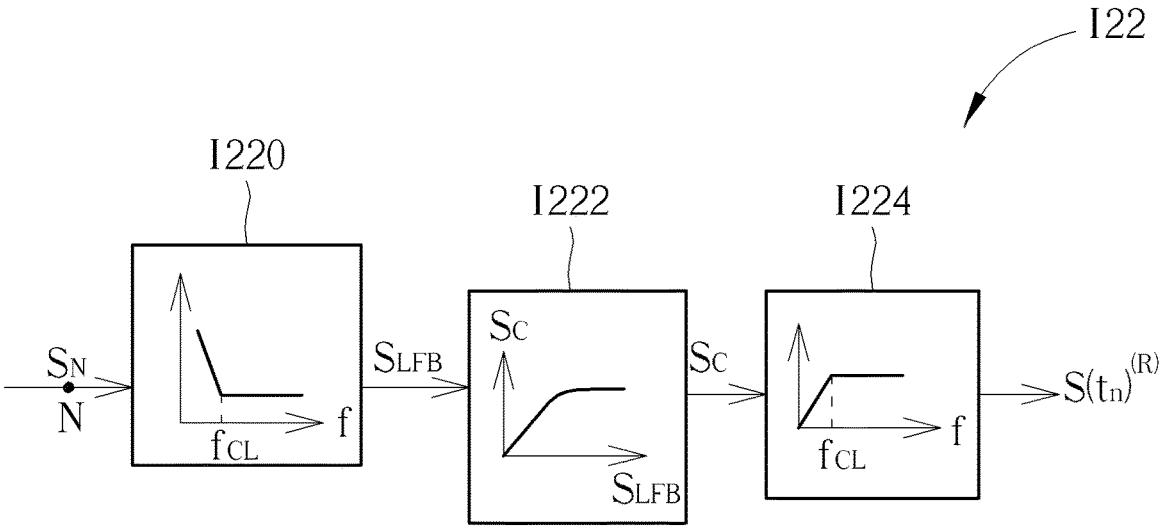
FIG. 25 is a schematic diagram of a reshaping sub-module according to an embodiment of the present invention.

The reshaping sub-module I22 is a low audio frequency dynamic range reshaper, which is configured to reshape/compress a dynamic range of the low audio frequency component of the samples $S(t_n)$ (or a first signal $S_N$ at the first node N) and generate a plurality of reshaped samples $S(t_n)^{(R)}$. In an embodiment, as shown in FIG. 25, the reshaping sub-module I22 comprises a low-frequency boosting portion I220, a compressing portion I222 and a low-frequency equalizing portion I224. The low-frequency boosting portion I220 is coupled to the first node N, configured to boost up or amplify the low frequency components of the first signal $S_N$ (the components of the first signal $S_N$ which are lower than a specific frequency $f_{CL}$) at the first node N, or equivalently, to perform a low-frequency boosting operation on the first signal $S_N$, and generate a low-frequency boosted signal $S_{LFB}$. The compressing portion I222 is to compress the low-frequency boosted signal $S_{LFB}$, to generate a compressed signal $S_C$. The input-output relationship is illustrated inside the block I222 in FIG. 25. For the low-frequency boosted signal $S_{LFB}$ being small, e.g., less than a certain value, the compressing portion I222 outputs the compressed signal $S_C$ as $S_C=S_{LFB}$. For the low-frequency boosted signal $S_{LFB}$ being greater than the certain value, the compressing portion I222 outputs the compressed signal $S_C$ as $S_C<S_{LFB}$, and a degree of compression $\Delta S=|S_C-S_{LFB}|$ increases as the low-frequency boosted signal $S_{LFB}$ increases. The low-frequency equalizing portion I224 is configured to equalize the low-frequency boosting operation which the low-frequency boosting portion I220 performs on the first signal $S_N$, i.e., to perform a low-frequency equalizing operation, where after the low-frequency boosting operation and the low-frequency equalizing operation are both and only applied to any signal, the result would be equal to the original signal. The low-frequency equalizing portion I224 eventually generates the reshaped samples $S(t_n)^{(R)}$. In this case, the mixing sub-module H202 performs a linear combination (i.e., the mixing operation) of the reshaped samples $S(t_n)^{(R)}$ and the filtered samples $S(t_n)^{(F)}$, and outputs the processed samples $S(t_n)^{(P)}$ as $S(t_n)^{(P)}=a \cdot S(t_n)^{(R)}+(1-a) \cdot S(t_n)^{(F)}$. In addition, the frequency $f_{CL}$ and the degree of compression $\Delta S$ may be controlled by the control unit H204.

The second filter I24 may also be an HPF, configured to perform a second high pass filtering operation on the samples $S(t_n)$. The second high-pass-filtering operation may be corresponding to a second cutoff frequency $f_{c2}$ and with a high cutoff rate approximately −48 dB/octave to −64 dB/octave below the cutoff frequency $f_{c2}$. The cutoff frequency $f_{c2}$ can be selected based on the maximum Phons that can be produced by the SPD under consideration, for example, the intersection between line G01 and curves of 20 Phons or 30 Phons in FIG. 21, which falls on 50 Hz and 65 Hz, to remove frequency components below cutoff frequency $f_{c2}$. These signal components cannot be reproduced in high enough loudness to be perceived by human hearing, as can indicated by equal loudness curve in FIG. 21, but can incur significant displacement of the membrane C25 during the operation of MEMS SPD C4. By filtering out frequency component below $f_{c2}$, the displacement of membrane C25 caused by such signal will be conserved and utilized instead in frequency ranges where human hearing has higher sensitivity. The cutoff frequency $f_{c2}$ may also be controlled by the control unit H204.

There are many ways to implement the signal processing chain of FIG. 23 and FIG. 24. As an example, but not limited thereto, the summing module E22 can be combined with the first filter H200 and replace the function of H200+E22 by a LPF (low pass filter) with the cutoff frequency $f_{c1}$. In this rearranged signal process scheme, the processed samples $S(t_n)^{(F)}$ may directly output to the converting module E24 from the mixing sub-module H202.

In an embodiment of FIG. 23 and/or FIG. 24, control unit H204 may employ a look-ahead buffer to accumulate Z pairs of $\{S(t_n), S(t_n)^{(F)}\}$ samples where Z is related to number of $\{S(t_n), S(t_n)^{(F)}\}$ samples required to produce reliable estimates of coefficient a for the cutoff frequency $f_{c2}$ of block I202. Control unit H204 can then calculate the maximum coefficients a according to these Z pairs of buffered $\{S(t_n), S(t_n)^{(F)}\}$ samples while satisfying the non-clipping criteria.

In an embodiment, the 9 cells in FIG. 16, instead of being treated as 7 driving nodes (D5-D0, A), these 9 cells can be wired in parallel and driven as one single multi-level voltage, e.g., $V_{D,A}$. In this case, the embodiment in which the 9 cells are wired in parallel and driven as one single multi-level voltage, the interface between E24 and C0 of FIG. 19 is simplified to one signal $V_{D,A}$, blocks F6 FIG. 20 may be unnecessary and all cells can be driven by $V_{D,A}$, from the multi-level output of block F4 and driven based on the principle behind eq. 4. In other words, this implementation is based purely on fractional-displacement $SPL \propto \Delta P \propto \Delta V_D$, the principle of eq. 5.

In the present embodiment, to achieve the same level of SPL resolution, the DAC resolution of FIG. 20 will need to be increased, e.g. a 18-bit DAC will need to be used for block F4 to achieve the same 18 bit-per-sample overall resolution of F0 as discussed in prior embodiment. In addition, since all cell with C4 of FIG. 16 are wired together into one driving node, the partition C4 of into 9 individual cells no longer serve the purpose of enhancing resolution and different arrangement can be made so long as the response time requirement of eq. 4 is satisfied.

One advantage of this implementation based purely on eq. 5 is the avoidance of switching noises, referring to the transitions from DAC modulated A cell to switch mode controlled D0~D5 cells and the transitions amongst D0~D5 as illustrated in one examples given prior.

Another advantage of this present embodiment is the reduction of wiring harness between E2 and C0 in FIG. 19 from 7 signals down to 1. This simplification can become a critical factor if driver E2 and SPD C0 cannot be integrated into one module or cannot be located right next to each other. On the other hand, the implementation based on 7 driving nodes, D5~D0+A, has the advantage of much cheaper DAC implementation since the cost of a 18 bps DAC will be much higher than that of a 14 bps DAC.

Other cell grouping, such as driving cell A as one multi-level voltage driven cell and the remaining eight other C2 of FIG. 16 as one large multi-level driven cell; or other combination of switch-mode driven cells and multi-level driven cells are all possible configurations under the present invention.

In addition, the flat-response maximizing module I20/H20 is not limited to be applied in the driving circuit for the position-based SPD, the module I20/H20 may also be applied in the driving circuit for the force-based SPD.

Furthermore, pulse shaping module similar to 3202 of FIG. 3 may be applied to the generation of $\Delta V_{Di}$ transitions in FIG. 18. For instance, a pulse shape such as one of the waveform from U.S. application Ser. No. 16/125,761, can be implemented by a database storing M* data samples of sub-steps, where M* may be between 10 to 50, and these M* sub-steps multiplied by $\Delta V_{Di}$ to produce M* sub-steps at M* the pulse rate such that each $\Delta V_{Di}$ transition in FIG. 18, instead of one single step, will be performed in M* sub-steps and the waveform will not be a step function, but one of the waveform from U.S. application Ser. No. 16/125,761, but not limited thereof.

Therefore, the sound producing apparatus E0 comprising the SPD C4 may produce a plurality of air pressure pulses at an air pulse rate, where the air pressure pulse rate is significantly higher than a maximum human audible frequency, and the plurality of air pressure pulses is PAM modulated according to the audio input signal S, which achieves the same effect as U.S. application Ser. No. 16/125,761. Compared to embodiments discussed U.S. application Ser. No. 16/125,761, instead of relying on valves to control the direction of the air pulses generated by operations of pumping element cells, two different approaches, the forced-based approach and the position-based approach, to produce fractional membrane displacements are demonstrated. Both approaches can produce the plurality of air pressure pulses required by the PAM-UPA sound production scheme discussed in U.S. application Ser. No. 16/125,761, without relying on the use of valves.

Referring back to FIG. 15, it can be seen that a strong aliasing components appear around the 21 Kpps pulse rate. The aliasing components surrounding 21 KHz may fall into or close to human audible frequency band, which is undesirable.

An ideal solution to bypass the aliasing problem is to increase the pulse rate. For example, the SPD 14 may operate at a pulse rate at 42 Kpps. However, not all treble speakers can bear such high frequency pulse rate.

Alternatively, in an embodiment, the SPD 14 of the sound producing apparatus 10 may produce a plurality of air pulse arrays $PA_1$-$PA_M$. Each air pulse array $PA_m$ has an original air pulse rate $R_{OP}$, e.g., 21 Kpps. The air pulse arrays $PA_1$-$PA_M$ are mutually interleaved, such that an overall pulse rate formed by the plurality of air pulse arrays $PA_1$-$PA_M$ is $M \cdot R_{OP}$.

Figure 26:
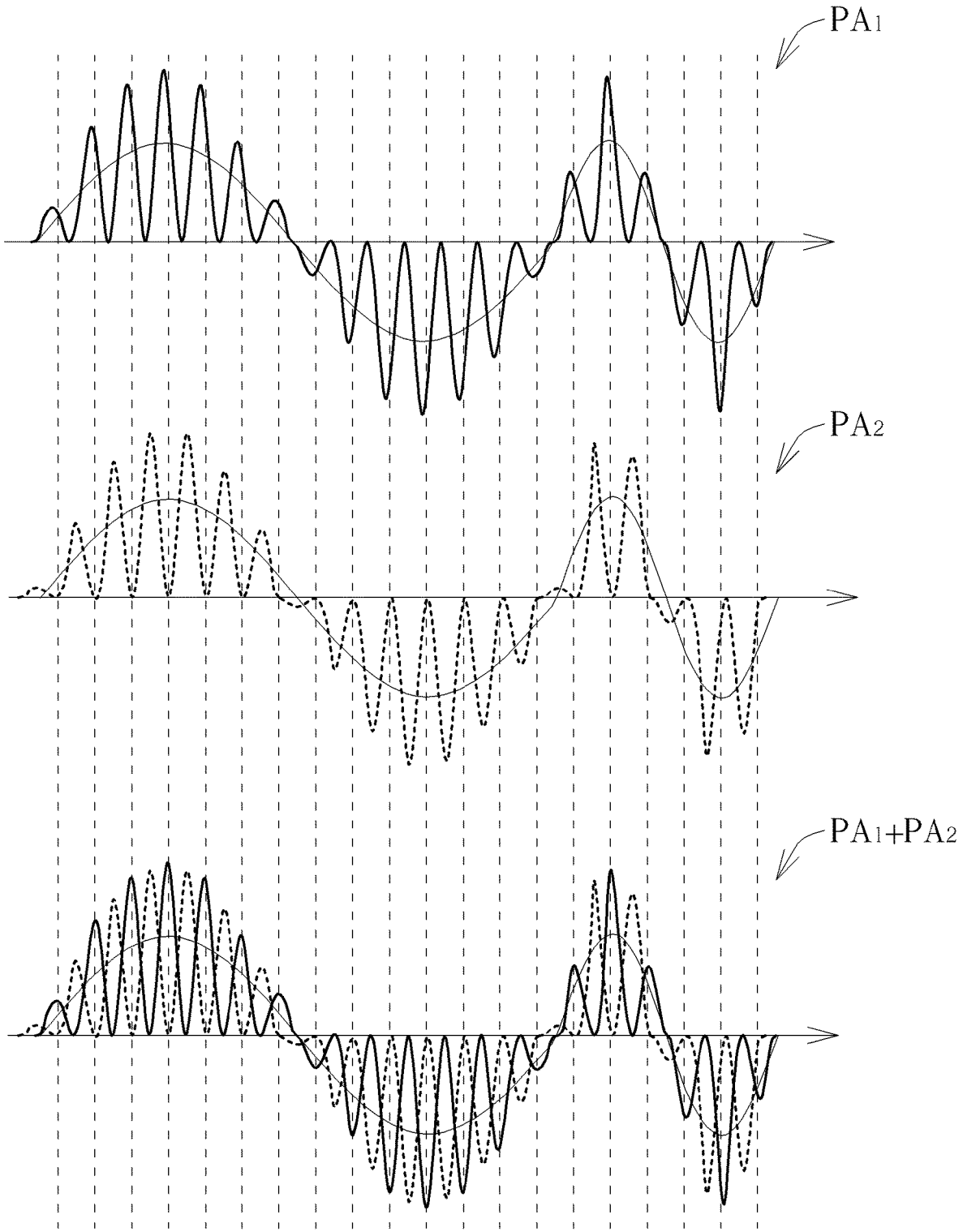
FIG. 26 illustrates waveforms of a plurality of air pulse arrays.

Illustratively, for an M=2 embodiment, FIG. 26 illustrates waveforms of the air pulse arrays PA1 and PA2. Each of the air pulse array PA1 and the air pulse array PA2 has the air pulse rate ROP, meaning that first peaks of the air pulse array PA1 are aligned with mid-points between two successive peaks of the air pulse array PA2. The air pulse array PA1 and the air pulse array PA2 are mutually interleaved in time-wise, such that an aggregation of the air pulse array PA1 and the air pulse array PA2 would have a pulse rate of 2·RP, e.g., 42 Kpps. Then, the aliasing component would be shifted toward 42 KHz, far beyond the human audible band.

Figure 27:
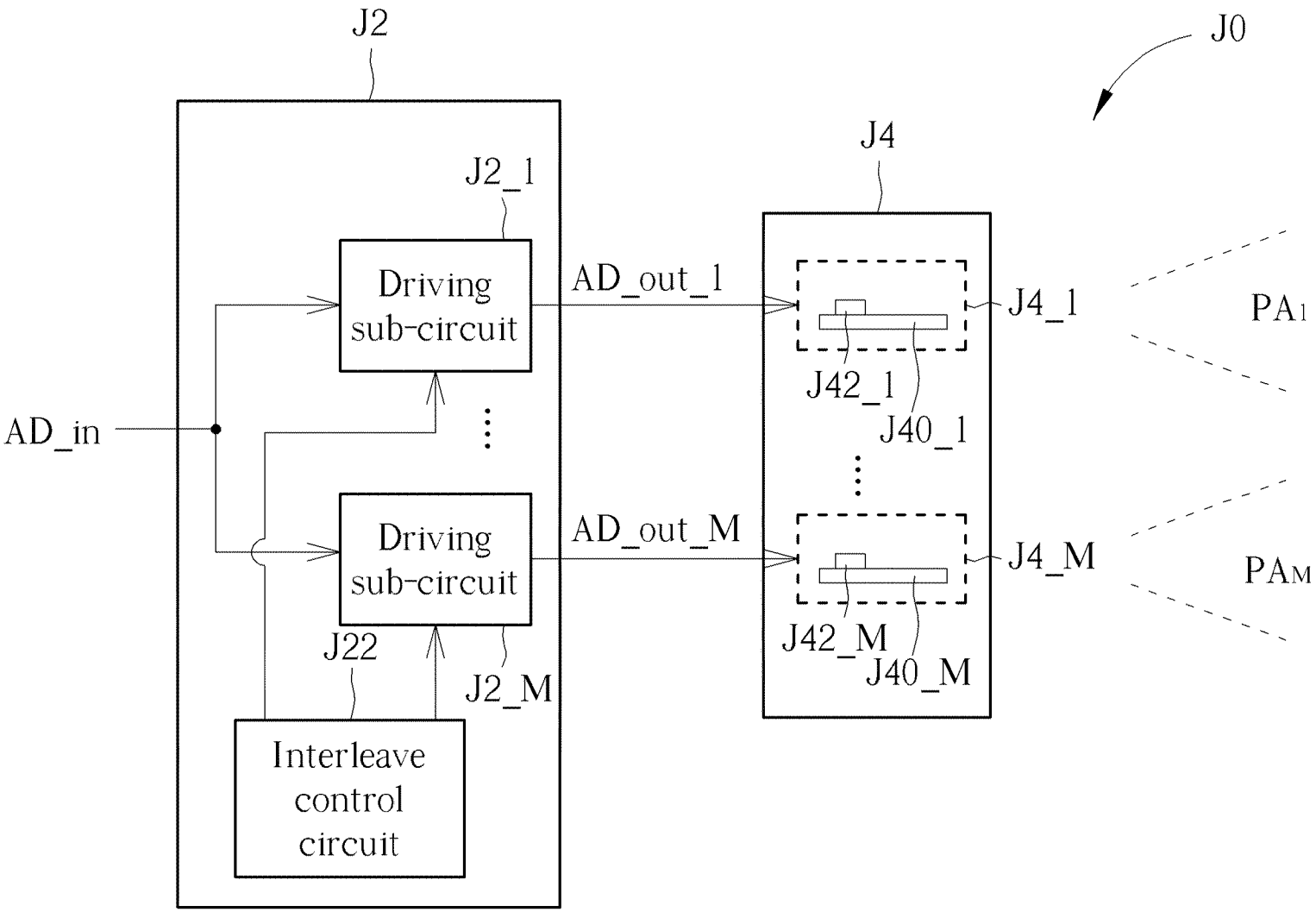
FIG. 27 is a schematic diagram of a sound producing apparatus according to an embodiment of the present invention.

FIG. 27 is a schematic diagram of a sound producing apparatus JO according to an embodiment of the present invention. The sound producing apparatus JO comprises a driving circuit J2 and a sound producing device J4.

The driving circuit J2 comprises a plurality of driving sub-circuits J2_1-J2_M. Each of the driving sub-circuits J2_1-J2_M may be realized by one of the driving circuits 32, A2, B2, E2 and the PAM module 820, which means that each driving sub-circuits J2_*m*, among the driving sub-circuits J2_1-J2_M, would have the same or similar circuit structure of one of the driving circuits 32, A2, B2, E2 and the PAM module 820. The driving sub-circuits J2_1-J2_M generates/outputs a plurality of driving sub-signals AD_out_1-AD_out_M. Each driving sub-signals AD_out_m may have same or similar characteristic feature as the driving signal AD_out generated by the driving circuits 32, A2, B2 and E2.

The sound producing device J4 comprises a plurality of membranes J40_1-J40_M and a plurality of electrodes J42_1-J42_M attached to the plurality of membranes J40_1-J40_M, respectively. The plurality of electrodes J42_1-J42_M receives the driving sub-signals AD_out_1-AD_out_M, to drive the plurality of membranes J40_1-J40_M, respectively, so as to produce the plurality of air pulse arrays $PA_1$-$PA_M$.

In addition, the driving circuit J2 may further comprises an interleave control circuit J22. The interleave control circuit J22 is coupled to the plurality of driving sub-circuit J2_1-J2_M and configured to control the plurality of driving sub-circuit J2_1-J2_M, such that the plurality of air pulse arrays $PA_1$-$PA_M$ produced by the plurality of driving sub-signals are mutually interleaved in time-wise. For example, the interleave control circuit J22 may control the sampling module, the up-sampling sub-module or the pulse shaping sub-module within the driving sub-circuits J2_1-J2_M, such that the plurality of air pulse arrays $PA_1$-$PA_M$ driven by the plurality of driving sub-signals AD_out_1~AD_out_M are mutually interleaved in time-wise. Preferably, the interleave control circuit J22 may control the driving sub-circuit J2_1-J2_M, such that the air pulse arrays $PA_m$ and $PA_{m+1}$ are mutually interleaved by ($T_{cycle}$/M) in time-wise.

In another perspective, the membranes J40_*m* and the electrode J42_*m* may form a sound producing sub-device J4_*m*, and the sound producing device J4 may be viewed as comprising a plurality of sound producing sub-devices J4_1-J4_M. In an embodiment, the sound producing sub-device J4_*m* may be a standalone treble speaker. The sound producing sub-devices J4_1-J4_M may be closely disposed, or be distributed disposed over/in a room or space.

In an embodiment, the sound producing sub-device J4_*m* may also be realized by the MEMS SPD C4. For the case of the sound producing sub-device J4_*m* being realized by the MEMS SPD C4, the interaction between the sound producing sub-device J4_*m* and the corresponding driving sub-circuit J2_*m* is the same as or similar to which between the driving circuit E2 and the SPD C4, which is not narrated herein for brevity.

Figure 28:
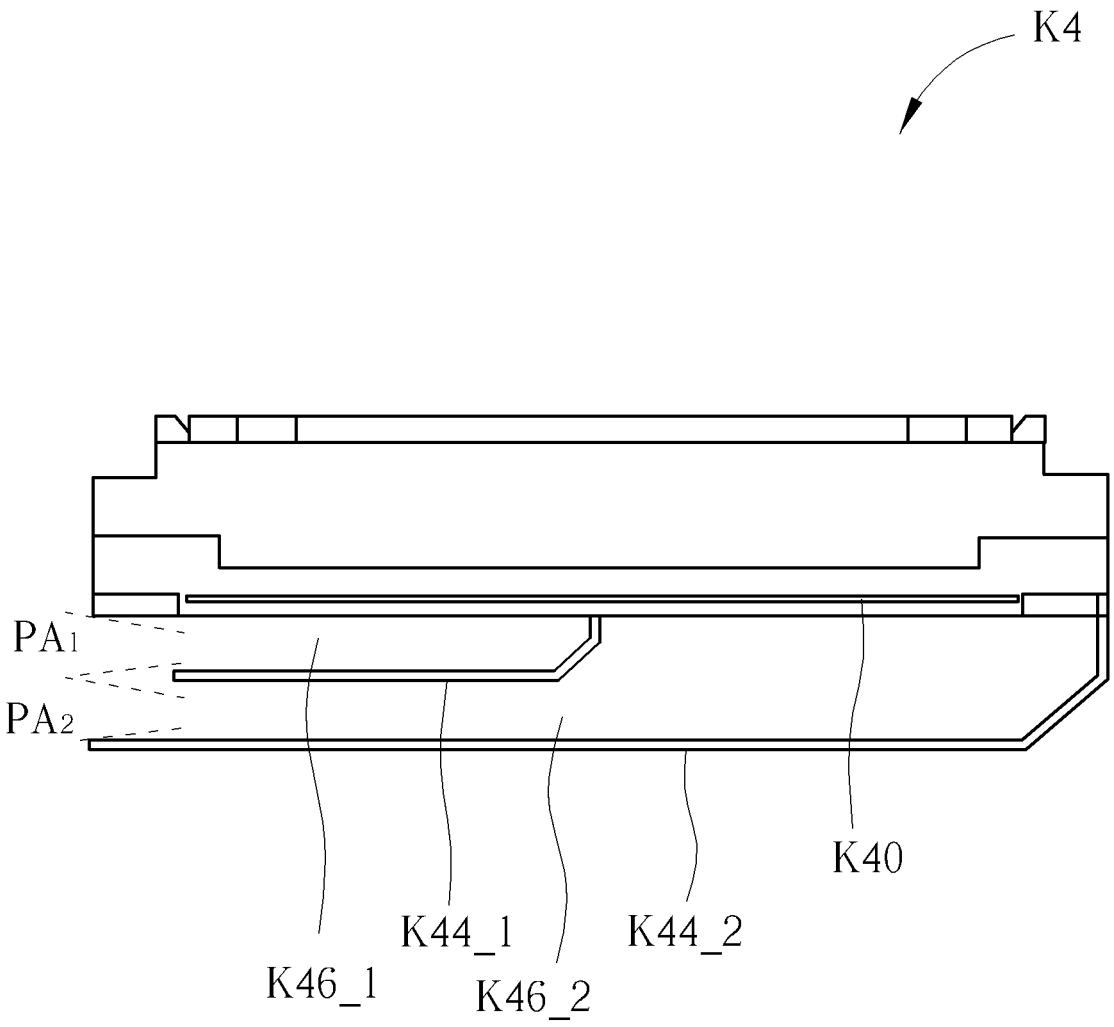
FIG. 28 is a schematic diagram of a sound producing device according to an embodiment of the present invention.

FIG. 28 is a schematic diagram of a sound producing device K4 according to an embodiment of the present invention. The sound producing device K4 is similar to an existing speaker CMS-16093-078X-67. The driving circuit coupled to the sound producing device K4 may be one of the driving circuits 32, A2 and B2 stated above. The sound producing device K4 comprises a membrane K40, configure to vibrate and produce a plurality of air pressure pulses according to the PAM-UPA sound production scheme. In addition, the sound producing device K4 further comprises waveguide components K44_1 and K44_2. The waveguide components K44_1 and K44_2 form pathways K46_1 and K46_2. The air pressure pulse would passes through the pathways K46_1 to produce, for example, the air pulse array $PA_1$, and passes through the pathways K46_2 to produce the air pulse array $PA_2$.

Lengths of the pathways K46_1 and K46_2 are properly designed such that the air pulse arrays $PA_1$ and $PA_2$ are mutually interleaved. For example, supposed that a length of CMS-16093-078X-67 is 16 mm and a wave length for 21 KHz pulse rate is 16.3 mm. The lengths of the pathways K46_1 and K46_2 may be designed such that a difference between the lengths of the pathways K46_1 and K46_2 is approximately 8.16 mm, such that the resulting air pulse arrays $PA_1$ and $PA_2$ are interleaved.

In summary, in the present application, the PAM-UPA driving scheme is utilized to drive the force-based SPD and the position-based SPD. Furthermore, the pulse interleaving scheme is provided to increase the overall pulse rate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound producing apparatus, comprising:

a driving circuit, configured to generate a driving signal according to an audio input signal; and a sound producing device, comprising a membrane and an electrode attached to the membrane;

wherein the electrode drives the membrane to reach a specific position according to the driving signal, such that the sound producing device produces a plurality of air pulses at an air pulse rate, the air pulse rate is higher than a maximum human audible frequency;

wherein the plurality of air pulses produces a non-zero offset in terms of sound pressure level, and the non-zero offset is a deviation from a zero sound pressure level.

2. The sound producing apparatus of claim 1, wherein the plurality of air pulses is aperiodic over a plurality of pulse cycles.

3. The sound producing apparatus of claim 1, wherein the sound producing device comprises a plurality of cells, and the plurality of cells comprises a plurality of cell membranes, a plurality of cell membrane actuators and a plurality of cell electrodes.

4. The sound producing apparatus of claim 3, wherein the driving circuit comprises:

a sampling module, receiving the audio input signal, configured to obtain a plurality of samples of the audio input signal at a plurality of sampling time instant; and a converting module, coupled to the sampling module, configured to generate a plurality of cell driving voltages;

wherein the plurality of cell driving voltages is applied to the plurality of cell electrodes.

5. The sound producing apparatus of claim 4, wherein the driving circuit comprises a summing module, the summing module is coupled to the sampling module and configured to perform a summing operation according to the plurality of samples to generate a driving voltage, the summing module performs the summing operation directly on the plurality of samples to generate the driving voltage, and the converting module generate a plurality of cell driving voltages according to the driving voltage.

6. The sound producing apparatus of claim 4, wherein the driving circuit further comprises:

a flat-response maximizing module, coupled between the sampling module and the converting module, receiving the plurality of samples of the audio input signal, configured to generate a plurality of processed samples, the flat-response maximizing module comprising:

a first filter, coupled to a first node, configured to perform a first filtering operation and generate a plurality of filtered samples according to the plurality of samples, wherein the first filtering operation is corresponding to a first cutoff frequency;

a mixing sub-module, comprising a first input terminal, a second input terminal and an output terminal, wherein the first input terminal is coupled to the first filter, the second input terminal is coupled to the first node, the mixing sub-module performs a mixing operation on the plurality of samples and the plurality of filtered samples according to a ratio coefficient, such that the output terminal outputs the plurality of processed samples; and a control unit, coupled to the mixing sub-module, configured to determine the ratio coefficient.

7. The sound producing apparatus of claim 6, wherein the control unit determines the ratio coefficient according to the plurality of processed samples.

8. The sound producing apparatus of claim 6, wherein the mixing sub-module performs the mixing operation on the plurality of samples and the plurality of filtered samples.

9. The sound producing apparatus of claim 6, wherein the flat-response maximizing module further comprises:

a reshaping sub-module, coupled between the first node and the second input terminal of the mixing sub-module, configured to generate a plurality of reshaped samples;

wherein the mixing sub-module performs the mixing operation on the plurality of reshaped samples and the plurality of filtered samples.

10. The sound producing apparatus of claim 9, wherein the reshaping sub-module comprises a low-frequency boosting portion, coupled to the first node, configured to perform a low-frequency boosting operation on a first signal at the first node to generate a low-frequency boosted signal;

a compressing portion, coupled to the low-frequency boosting portion, configured to perform a compressing operation on the low-frequency boosted signal to generate a compressed signal; and a low-frequency equalizing portion, coupled to the compressing portion, configured to perform a low-frequency equalizing operation on the compressed signal;

wherein the low-frequency equalizing portion outputs the plurality of reshaped samples.

11. The sound producing apparatus of claim 6, wherein the driving circuit further comprises:

a second filter, coupled between the sampling module and the first node, configured to perform a second filtering operation, wherein the second filtering operation is corresponding to a second cutoff frequency.

12. The sound producing apparatus of claim 1, wherein an sound pressure level produced by the sound producing device within a pulse cycle is dependent on a position difference of the membrane between two consecutive pulse cycles.

13. The sound producing apparatus of claim 1, wherein an sound pressure level produced by the sound producing device within a pulse cycle is dependent on a voltage difference, applied to the electrode, between two consecutive pulse cycles.

14. The sound producing apparatus of claim 1, wherein an sound pressure level produced by the sound producing device within a pulse cycle is independent of an absolute position of the membrane.

15. The sound producing apparatus of claim 1, wherein an sound pressure level produced by the sound producing device within a pulse cycle is independent of an absolute voltage which is applied to the electrode.

16. The sound producing apparatus of claim 1, wherein a membrane response time constant of the membrane is smaller than air pulse cycle.

17. An flat-response maximizing module, applied in a driving circuit within a sound producing apparatus, receiving an input signal, comprising:

a first filter, configured to perform a first filtering operation and generate a filtered signal according to the input signal, wherein the first filtering operation is corresponding to a first cutoff frequency;

a mixing sub-module, comprising a first input terminal, a second input terminal and an output terminal, wherein the first input terminal is coupled to the first filter, the second input terminal receives the input signal, the mixing sub-module performs a mixing operation on the input signal and the filtered signal according to a ratio coefficient, such that the output terminal outputs a processed signal; and a control unit, coupled to the mixing sub-module, configured to determine the ratio coefficient.

18. The flat-response maximizing module of claim 17, wherein the flat-response maximizing module further comprises:

a reshaping sub-module, coupled to the second input terminal of the mixing sub-module, configured to generate a reshaped signal according to the input signal;

wherein the mixing sub-module performs the mixing operation on the reshaped signal and the filtered signal.

19. The flat-response maximizing module of claim 18, wherein the reshaping sub-module comprises a low-frequency boosting portion, configured to perform a low-frequency boosting operation on the input signal to generate a low-frequency boosted signal;

a compressing portion, coupled to the low-frequency boosting portion, configured to perform a compressing operation on the low-frequency boosted signal to generate a compressed signal; and a low-frequency equalizing portion, coupled to the compressing portion, configured to perform a low-frequency equalizing operation on the compressed signal;

wherein the low-frequency equalizing portion outputs the reshaped signal.

* * * * *